US009334109B1

(12) United States Patent
Mueller et al.

(10) Patent No.: US 9,334,109 B1
(45) Date of Patent: May 10, 2016

(54) VAPOR RECOVERY SYSTEMS AND METHODS UTILIZING SELECTIVE RECIRCULATION OF RECOVERED GASES

(71) Applicants: Hans Peter Mueller, Denver, CO (US); David Scott Gorham, Denver, CO (US); Nicholas Taylor Koerner, Denver, CO (US); Richard deCourville Chapman, Jr., Butte, MT (US)

(72) Inventors: Hans Peter Mueller, Denver, CO (US); David Scott Gorham, Denver, CO (US); Nicholas Taylor Koerner, Denver, CO (US); Richard deCourville Chapman, Jr., Butte, MT (US)

(73) Assignee: EcoVapor Recovery Systems, LLC, Denver, CO (US)

( * ) Notice: Subject to any disclaimer, the term of this patent is extended or adjusted under 35 U.S.C. 154(b) by 0 days.

(21) Appl. No.: 14/578,281

(22) Filed: Dec. 19, 2014

Related U.S. Application Data

(63) Continuation-in-part of application No. 14/286,983, filed on May 23, 2014, which is a continuation-in-part of application No. 13/365,247, filed on Feb. 2, 2012.

(60) Provisional application No. 61/918,583, filed on Dec. 19, 2013.

(51) Int. Cl.
*F25J 1/00* (2006.01)
*C10G 5/06* (2006.01)
*B65D 90/30* (2006.01)
(Continued)

(52) U.S. Cl.
CPC . *B65D 90/30* (2013.01); *C10G 5/06* (2013.01)

(58) Field of Classification Search
CPC ..... E21B 43/00; E21B 43/12; C07C 9/00; C07C 9/02; C07C 9/04; C10G 5/00; C10G 5/06; C10G 2300/00; C10G 2300/10; C10G 2300/1025; C10G 2300/1033; F25J 1/00; F25J 1/0032; F25J 1/0035; F25J 1/004
See application file for complete search history.

(56) References Cited

U.S. PATENT DOCUMENTS 1,653,387 A 12/1927 Brown
2,126,367 A 8/1938 Clawson et al.
(Continued)

FOREIGN PATENT DOCUMENTS

JP 08034497 A 2/1996
WO 2005045173 A2 5/2005

OTHER PUBLICATIONS

Portable Vapor Bladders; R.A. Nichols Engineering (www.raneng.com); downloaded Nov. 7, 2014; 2 pgs.
(Continued)

*Primary Examiner* — Natasha Young
(74) *Attorney, Agent, or Firm* — Dinsmore & Shohl LLP

(57) ABSTRACT

System and methods for recovering flash gas from at least one flash gas source. A system may include a controllable inlet valve having an input in fluid communications with the flash gas source to receive flash gas; a compressor having an input in fluid communications with an output of the inlet valve to receive the flash gas when the inlet valve is open, the compressor compressing the flash gas to form compressed gas; a controllable recirculation valve in fluid communications with an output of the compressor and the output of the inlet valve; and a controller coupled with and selectively controlling the inlet valve and the recirculation valve between i) a pass-through mode wherein the inlet valve is open and the recirculation valve is closed, and ii) a recirculation mode wherein the inlet valve is closed and the recirculation valve is opened. Various embodiments are disclosed.

20 Claims, 9 Drawing Sheets

(51) Int. Cl.

| | |
|---|---|
| *C10G 5/00* | (2006.01) |
| *E21B 43/00* | (2006.01) |
| *E21B 43/12* | (2006.01) |
| *C07C 9/00* | (2006.01) |
| *C07C 9/02* | (2006.01) |
| *C07C 9/04* | (2006.01) |

(56) References Cited

U.S. PATENT DOCUMENTS

| | | | | |
|---|---|---|---|---|
| 2,947,379 | A | | 8/1960 | Aubrey |
| 3,331,194 | A | | 7/1967 | Reed et al. |
| 3,707,157 | A | | 12/1972 | Tipton et al. |
| 4,273,189 | A | | 6/1981 | Carpenter |
| 4,422,301 | A | | 12/1983 | Watt et al. |
| 4,579,565 | A | | 4/1986 | Heath et al. |
| 4,747,853 | A | | 5/1988 | Haslett et al. |
| 5,132,011 | A | | 7/1992 | Ferris et al. |
| 5,135,360 | A | | 8/1992 | Anderson |
| 5,139,390 | A | | 8/1992 | Rajewski |
| 5,149,344 | A | | 9/1992 | Macy et al. |
| 5,195,587 | A | | 3/1993 | Webb |
| 5,249,593 | A | | 10/1993 | Higgins et al. |
| 5,524,456 | A | | 6/1996 | Stokes |
| 5,651,389 | A | | 7/1997 | Anderson |
| 5,775,442 | A | | 7/1998 | Speed |
| 5,900,137 | A | | 5/1999 | Homan et al. |
| 5,970,957 | A | * | 10/1999 | Fried et al. ..... 123/516 |
| 5,979,481 | A | | 11/1999 | Ayresman |
| 6,209,651 | B1 | | 4/2001 | Knight |
| 6,363,959 | B1 | | 4/2002 | Ollivier |
| 6,422,313 | B1 | | 7/2002 | Knight |
| 6,527,002 | B1 | | 3/2003 | Szakaly |
| 6,681,789 | B1 | | 1/2004 | Moulis |
| 6,881,329 | B2 | | 4/2005 | Amado et al. |
| 6,955,704 | B1 | | 10/2005 | Strahan |
| 7,069,942 | B2 | | 7/2006 | Trefall et al. |
| 7,350,581 | B2 | | 4/2008 | Wynn |
| 7,504,037 | B2 | | 3/2009 | Gibbs |
| 7,645,433 | B2 | | 1/2010 | Rhodes et al. |
| 7,695,702 | B2 | | 4/2010 | Rhodes et al. |
| 7,749,308 | B2 | | 7/2010 | McCully |
| 7,766,031 | B2 | | 8/2010 | Platusich et al. |
| 8,133,300 | B1 | | 3/2012 | Gonsalves, III et al. |
| 8,206,124 | B1 | | 6/2012 | Varani et al. |
| 8,475,966 | B2 | | 7/2013 | Knight et al. |
| 8,529,215 | B2 | | 9/2013 | Heath et al. |
| 8,708,663 | B1 | | 4/2014 | Varani et al. |
| 8,992,838 | B1 | | 3/2015 | Mueller |
| 2003/0183394 | A1 | | 10/2003 | Reitz |
| 2005/0051503 | A1 | | 3/2005 | Holland et al. |
| 2006/0144080 | A1 | | 7/2006 | Heath et al. |
| 2007/0284240 | A1 | | 12/2007 | Rhodes et al. |
| 2008/0202593 | A1 | | 8/2008 | Allard et al. |
| 2010/0154727 | A1 | | 6/2010 | Malgorn et al. |
| 2010/0158717 | A1 | | 6/2010 | Vogt |
| 2010/0263758 | A1 | | 10/2010 | Young |
| 2011/0186305 | A1 | * | 8/2011 | Wilde ..... 166/380 |

OTHER PUBLICATIONS

Rane Ring Vapor Holder Systems; R.A. Nichols Engineering (www.raneng.com); downloaded Nov. 7, 2014; 2 pages.

Vapor Holders, R.A. Nichols, Engineering (www.raneng.com); downloaded Nov. 7, 2014; 2 pgs.

Truck Transportable Portable Vapor Bladder; R.A. Nichols Engineering (www.raneng.com); downloaded Nov. 7, 2014; 3 pgs.

Terminal Vapor Recovery Sizing Data; R.A. Nichols Engineering (www.raneng.com); downloaded Nov. 7, 2014; 1 pg.

Trotter, Gary L. & Rhodes, Zane Q., "Catalytic Oxygen Removal for the Aberdeen Coal Mine Methane Project in Carbon County, Utah", downloaded on Jun. 29, 2015, pp. 1-9, available at www.newpointgas.com/blog/wp-content/uploads/2009/11/zanes-2008-gpa-paper-website.pdf.

Newpoint Gas, LP, "Oxygen Removal from Natural Gas: Newpoint Gas O2 Removal Services", downloaded on Jun. 29, 2015, pp. 1-2, available at www.newpointgas.com/naturalgas_oxygen.php.

* cited by examiner

| Input Conditions | | | Controller-Selected Valve Position | | Recovery System Mode |
|---|---|---|---|---|---|
| Pressure | Temperature | Oxygen | Inlet Valve | Recirculation Valve | |
| Flash Gas Source Pressure > Desired Set Point<br>Compressor Inlet Suction Pressure > Desired Set Point<br>Discharge Pressure < Desired Set Point | Reactor Vessel Temperature < Desired Set Point | Inlet O2 Concentration < Desired Set Point<br>Outlet O2 Concentration < Desired Set Point | Open | Closed | Full Pass-Through Mode |
| Flash Gas Source Pressure < Desired Set Point<br>Compressor Inlet Suction Pressure at Desired Set Point<br>Discharge Pressure > Desired Set Point | Reactor Vessel Temperature > Desired Set Point | Inlet O2 Concentration > Desired Set Point<br>Outlet O2 Concentration > Desired Set Point | Closed | Open | Full Recirculation Mode |

FIG. 7

VAPOR RECOVERY SYSTEMS AND METHODS UTILIZING SELECTIVE RECIRCULATION OF RECOVERED GASES

CROSS-REFERENCE TO RELATED APPLICATIONS

This application claims priority to and the benefit under 35 U.S.C. 119(e) of U.S. Provisional Patent Application No. 61/918,583 filed Dec. 19, 2013 entitled "Vapor Recovery Systems and Methods Utilizing Selective Recirculation of Recovered Gases" the disclosure of which is hereby incorporated by reference in its entirety. This application is also a continuation-in-part of U.S. patent application Ser. No. 14/286,983 entitled "Hydrocarbon Vapor Recovery System with Oxygen Reduction" filed May 23, 2014, which is a continuation-in-part of U.S. patent application Ser. No. 13/365,247, now U.S. Pat. No. 8,992,838, entitled "Hydrocarbon Vapor Recovery System" filed Feb. 2, 2012, the disclosures of which are hereby incorporated by reference in their entirety.

TECHNICAL FIELD

The present disclosure relates generally to recovery of natural gas and vapors from wells and other sources, and in particular relates to vapor recovery systems using recirculation.

BACKGROUND

In oil recovery, storage and transportation operations, hydrocarbon gases are produced from oil condensate storage tanks and other sources through flash losses, working losses, standing losses, and breathing losses, where liquid hydrocarbons evaporate into gaseous form. Working losses occur when the liquids are agitated, i.e., when new liquids are pumped into the tanks; breathing losses are primarily the result of diurnal heating of the tanks; and flash losses occur when liquid hydrocarbons experience a sudden pressure drop, an example of which can occur when liquid hydrocarbons move from a separator (i.e., at approximately 30-400 psig or more) to an oil condensate storage tank at much lower pressure (i.e., 0 to 2 psig). Flash losses account for a significant portion of total losses. Collectively, all of these losses of hydrocarbon gases are referred to herein interchangeably as "flash emissions," "vent gas," "flash gas," "vapor" and combinations thereof. As recognized by the present inventors, all of these losses may occur in a variety of situations involving oil storage tanks, vapor recovery towers, three-phase separators, water storage tanks (for instance as used in oil and natural gas production operations), flow-back tanks (for instance as used in hydraulic fracturing operations), and during the transportation of oil and gases with rail cars, oil hauling trucks, offloading stations and the like.

Flash emissions include Volatile Organic Compounds (VOC) and therefore pose a hazard to air quality as they form ground level ozone when they react with NOx. Historically, such gases were vented through relief valves of the storage tanks into the atmosphere.

To protect the environment and the health of the public at large, the permissible levels for ground level ozone and, in turn, uncontrolled flash emissions from flash gas sources such as oil storage tanks are regulated by various regulatory agencies at federal and state levels. Methods of flash emissions control include flaring, where the flash emissions are burned off, and more advanced systems of vapor recovery that capture, compress, and inject these flash emissions into nearby gas gathering pipelines, such as described in U.S. Pat. No. 7,350,581.

SUMMARY

According to one broad aspect of one embodiment of the present disclosure, disclosed herein are vapor recovery systems and processes that can be connected with flash gas sources (such as but not limited to conventional oil storage tanks or other sources of flash gas, flash emissions, fugitive emissions, vent gas, vapor, flash losses, working losses, standing losses, and breathing losses, and combinations thereof) and natural gas lines, wherein the recovery systems can capture and process vapor/gases emanating from the flash gas sources, and wherein the recovery systems use selective recirculation of recovered gases/vapors within the vapor recovery system. The recovery systems can be configured to be continuously operating and selectively cycling through various modes, for instance in one example, between a pass-through mode and a recirculation mode depending upon various operating conditions as described herein.

According to another broad aspect of another embodiment of the present disclosure, disclosed herein is a system for recovering flash gas from at least one flash gas source. In one example, the system may include a controllable inlet valve having an input coupled with the flash gas source, the inlet valve receiving the flash gas, the inlet valve having an output; a compressor having an input coupled with the output of the inlet valve, the compressor configured to receive the flash gas from the inlet valve when the inlet valve is open, the compressor compressing the flash gas to form compressed gas, the compressor providing the compressed gas at an output or discharge point; a controllable recirculation valve coupled between the output of the compressor and the output of the inlet valve; and a controller coupled with the inlet valve and the recirculation valve, the controller selectively controlling the inlet valve and the recirculation valve between i) a pass-through mode wherein the inlet valve is open and the recirculation valve is closed, and ii) a recirculation mode wherein the inlet valve is closed and the recirculation valve is opened.

In one example, the system may also include a pressure sensor measuring a pressure of flash gas in the flash gas source, wherein the controller activates the pass-through mode when the pressure sensor detects pressure within the flash gas source that is above a desired set point. The controller may activate the recirculation mode when the pressure sensor detects pressure within the flash gas source that is below a desired set point.

In one example, the system may also include a pressure sensor measuring a pressure of suction at the input of the compressor, wherein the controller activates the pass-through mode when the pressure of suction is above a desired set point. The controller may activate the recirculation mode when the pressure of suction is below a desired set point.

In one example, the system may also include an outlet pressure sensor measuring an outlet pressure at the output of the compressor, wherein the controller activates the pass-through mode when the outlet pressure is below a desired set point. The controller may activate the recirculation mode when the outlet pressure is above a desired set point.

In one example, the system may also include an inlet oxygen sensor measuring an oxygen content level of the flash gas at the input of the compressor, wherein the controller activates the pass-through mode when the oxygen content level is below a desired set point. The controller may activate the recirculation mode when the oxygen content level is above a desired set point.

In one example, the system may also include an outlet oxygen sensor measuring an oxygen content level of the compressed gas at the output of the compressor, wherein the controller activates the pass-through mode when the oxygen content level of the compressed gas is below a desired set point. The controller may activate the recirculation mode when the oxygen content level of the compressed gas is above a desired set point.

In one example, the inlet valve, the compressor, the recirculation valve and the controller are positioned on a platform, and when the system is operating in recirculation mode, no flash gas enters the system from the flash gas source and no compressed gas exits the system.

In one example, the system may also include an oxygen reduction subsystem receiving the compressed gas from the compressor, the oxygen reduction subsystem reducing an amount of dioxygen contained within the compressed gas.

According to another broad aspect of another embodiment of the present disclosure, disclosed herein is a system for recovering flash gas from at least one flash gas source. In one embodiment, the system may include a controllable inlet valve having an input in fluid communications with the flash gas source to receive the flash gas, the inlet valve having an output; a compressor having an input in fluid communications with the output of the inlet valve to receive the flash gas when the inlet valve is open, the compressor compressing the flash gas to form compressed gas, the compressor providing compressed gas at an output; a controllable recirculation valve in fluid communications with the output of the compressor and the output of the inlet valve; and a controller electronically coupled with the inlet valve and the recirculation valve, the controller selectively controlling the inlet valve and the recirculation valve between i) a pass-through mode wherein the inlet valve is open and the recirculation valve is closed, and ii) a recirculation mode wherein the inlet valve is closed and the recirculation valve is opened and no flash gas enters the system from the flash gas source and no compressed gas exits the system in the recirculation mode.

In one example, the system may also include a pressure sensor measuring a pressure of flash gas in the flash gas source, wherein the controller activates the pass-through mode when the pressure sensor detects pressure within the flash gas source that is above a desired set point. The controller may activate the recirculation mode when the pressure sensor detects pressure within the flash gas source that is below a desired set point.

In one example, the system may also include a pressure sensor measuring a pressure of suction at the input of the compressor, wherein the controller activates the pass-through mode when the pressure of suction is above a desired set point. The controller may activate the recirculation mode when the pressure of suction is below a desired set point.

In one example, the inlet valve, the compressor, the recirculation valve and the controller are positioned on a platform. The system may also include an oxygen reduction subsystem in fluid communications with the compressor to receive the compressed gas, the oxygen reduction subsystem reducing an amount of dioxygen contained within the compressed gas.

Other embodiments of the disclosure are described herein. The features, utilities and advantages of various embodiments of this disclosure will be apparent from the following more particular description of embodiments as illustrated in the accompanying drawings.

BRIEF DESCRIPTION OF THE DRAWINGS

FIG. 7 illustrates an example of input conditions and operation modes of a vapor recovery system, in accordance with one embodiment of the present disclosure.

DETAILED DESCRIPTION

Figure 1:
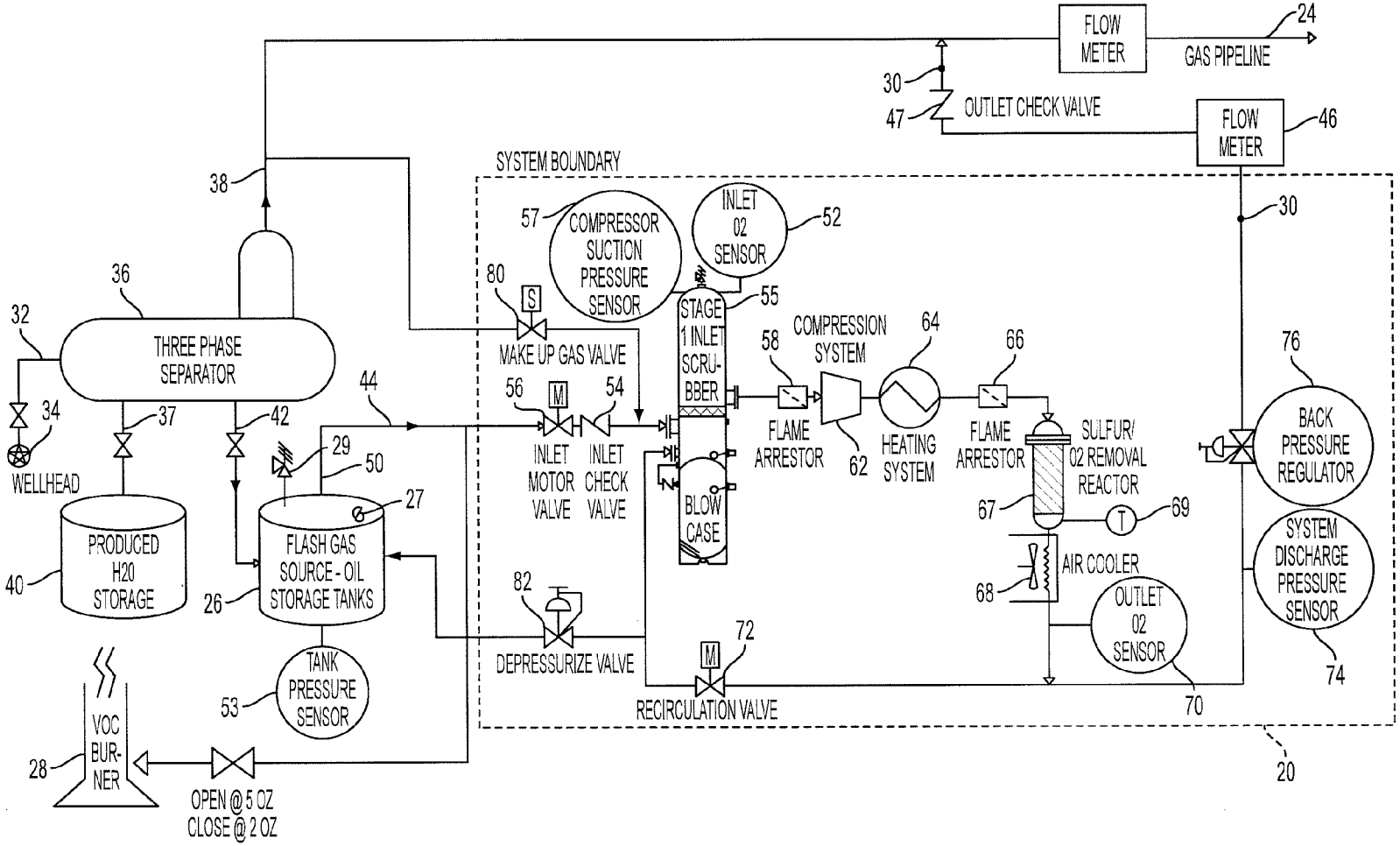
FIG. 1 illustrates a block diagram of an example of a vapor recovery system coupled with one or more flash gas sources (shown in this example as oil storage tanks), in accordance with one embodiment of the present disclosure.

Disclosed herein in FIGS. 1-8 are various embodiments of mechanisms and processes for providing vapor recovery using selective recirculation of recovered gases/vapors within a vapor/gas recovery system. Embodiments of the present disclosure may be used by various vapor recovery systems, such as systems 20 described herein, to recover flash gas, flash emissions, vent gas, vapor and other gases that result from flash losses, working losses, standing losses, breathing losses and the like (for simplicity of this disclosure, the different types of gases are referred to interchangeably as "flash gases")—from various sources or vessels containing or producing such gases, such as but not limited to oil storage tanks, vapor recovery towers, three-phase separators, water storage tanks (for instance as used in oil and natural gas production operations), flow-back tanks (for instance as used in hydraulic fracturing operations), rail cars, oil hauling trucks, off-loading stations (for instance as used in the transportation of produced oil), or others flash gas sources (for simplicity of this disclosure, these various sources are referred to interchangeably as "flash gas sources").

In one example, various modes of operation may be supported and selectively activated/engaged within a vapor recovery system 20, including a) full, pass-through mode where new gas/vapor is introduced at the system input, compressed and processed by the system, and pushed through the system out to the system output, such as to a gas gathering pipeline; and b) a recirculation mode of processed gas/recovered gas, where no new recovered gas or flash gas is introduced into the system or pushed out of the system, instead the same gas that exists within the recovery system boundaries is continuously recirculated within the recovery system (for example, from the suction end of the compressor, through all stages of compression, and back to the suction end of the compressor). In one example, a vapor recovery system 20 is configured to operate continuously and selectively cycles between the above-described modes of operation depending on one or more conditions detected by the vapor recovery system. The vapor recovery system and its various components and sub-systems may be configured to be positioned on a skid or a platform, such as shown in FIG. 7, and connected with flash gas source 26 (such as at a conventional well site) so that the vapor recovery system, when operating, recovers vapors and gases from the flash gas source that would otherwise escape into the atmosphere. The vapor recovery system processes the recovered vapors/gases, and injects the recovered vapors/gases, after processing by the vapor recovery system, into a gas sales line for use upon meeting certain criteria set forth and detected by the vapor recovery system.

In accordance with embodiments of the present disclosure, recirculation allows the recovery system 20 to continuously operate/remain on and ready to process vapor/gas as soon as the vapor/gas is available for recovery. Externalities (i.e. an open hatch on an oil storage tank that allows flash gas to vent to the atmosphere rather than be directed towards a vapor recovery system or flare) do not affect system runtime, because in on example, the recirculating gas does not exit the system until the conditions warranting recirculation are no longer present. Moreover, another benefit of recirculation is that the system is able to take multiple passes at processing the same gas/vapor molecules to ensure effective processing (i.e., recirculation can provide more effective oxygen removal from the processed gas stream in embodiments where an oxygen removal system may be utilized).

Additionally, in contrast with other systems that start/stop gas processing based on whether flash gas is present in the flash gas source, by de-coupling runtime of embodiments of the present invention from gas volume passed through the system, recirculation allows the recovery system 20 to move beyond intermittent start/stop operations to more continuous operations. This is beneficial because less wear and tear occurs on a recovery system with fewer cold startups. Continuous operations of a recovery system also effectively allow the system to more efficiently capture and process more volume of recovered vapor/gas because the system is running and system's components are at operating temperatures and, in one embodiment, ready to process the recovered vapor/gases at the moment that vapor/gases are produced in the flash gas source. Said differently, continuous operation ensures that the recovery system is ready to process gas the instant that gas is available and present at the system inlet. This is different from systems using start/stop operations where such systems have to startup and get up to operating temperatures and other operating conditions before they are able to process newly received flash gases.

Additionally, embodiments of the present disclosure provide recirculation of recovered gas/vapor which allows the vapor recovery system 20 as a whole to actively regulate pressure in the upstream flash gas sources (i.e., oil storage tanks) by sucking/removing gas/vapor from said tanks down to a low tank pressure set point (i.e., 0.25 oz/sqin in one embodiment). Once the low tank pressure set point is reached, the inlet valve (described below) of the vapor recovery system can be closed which in one example places the recovery system into recirculation, preventing further flash gas/vapor from being removed from the tanks and pulled into the system through the inlet valve. As more flash gas/vapor is produced at the tanks, pressure in the tanks rises. Once the tank pressure reaches a high tank pressure set point (i.e., 1.5 oz/sqin in one embodiment), the inlet valve of the recovery system can be opened which in one example can transition the recovery system from the recirculation mode, to a pass-through mode where once again the recovery system removes/draws gas/vapor from the flash gas source (i.e., tanks) until the low tank pressure set point is once again reached.

In one example of the present disclosure, all gas is recirculated on a skid or platform that contains the components of a gas recovery system 20. The skid can define the recovery system's boundaries of inputs and outputs, and the recovery system on the skid can be self-contained except for the connections to the flash gas source (i.e., storage tanks) (such connections may include system inlet and liquids return line, fuel gas supply (if the primary driver is an engine that uses natural gas as fuel), and the gas gathering pipeline. As opposed to an external recirculation system which may potentially introduce oxygen contamination into the flash gas or may burn off recirculated gases by the flaring process, on-skid recirculation of embodiments of the present disclosure advantageously prevents gas reintroduction into the flash gas sources (i.e., oil storage tanks).

Recirculation of recovered gas by a vapor recovery system 20 in accordance with embodiments of the present disclosure also provides additional environmental benefits, as recognized by the present inventors. By recirculating gas on-skid (within the system boundary) until conditions permit processing of new volumes of flash vapor/gas, the recovery system can be continuously operating and ready to compress/process new flash gas/vapor the instant it is produced or present within the flash gas source and reaches the inlet valve of the recovery system. This leads to nearly 100% efficient capture of flash gases with a properly functioning and sized recirculation system, which is believed to be an improvement over other systems that use a start and stop control regime and that may discharge or burn-off gas into the atmosphere during their system startup conditions.

Moreover, recirculation of recovered gas by a vapor recovery system 20 in accordance with embodiments of the present disclosure also may actively reduce pressures within flash gas sources such as oil storage tanks, and that can translate into less forceful releases of vapors containing volatile organic compounds (VOCs) when tank hatches are opened (i.e. during tank level gaging operations, when checking for bulk solids or water content, etc.) by well/lease operators or personnel. Since this procedure is most often done manually, lower tank pressures achieved through embodiments of the present disclosure reduce the likelihood or amount of volatile organic compound emissions that operations personnel may be exposed to, which will thereby improve safety.

Also, in extreme or adverse climates, in accordance with some embodiments of the present disclosure, keeping an engine (such as a compressor engine) of a vapor recovery system 20 running in a continuous operation mode can prevent or reduce the risk of freezing, overheating, dead batteries, and startup failures thus maintaining a more constant processing environment.

Figure 4A:
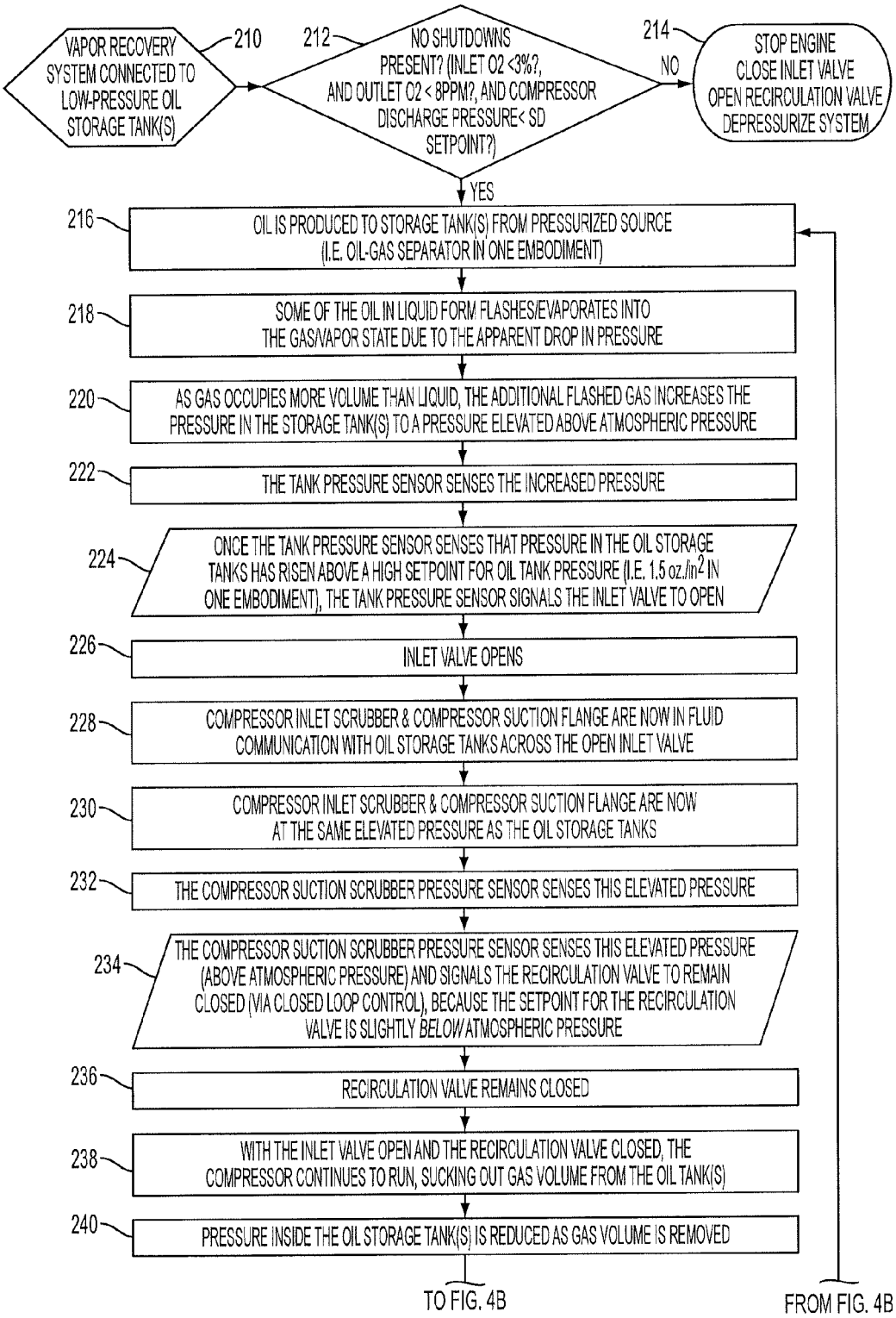
FIGS. 4A-4B illustrate an example of a process for a vapor recovery system, in accordance with one embodiment of the present disclosure.
Figure 4B:
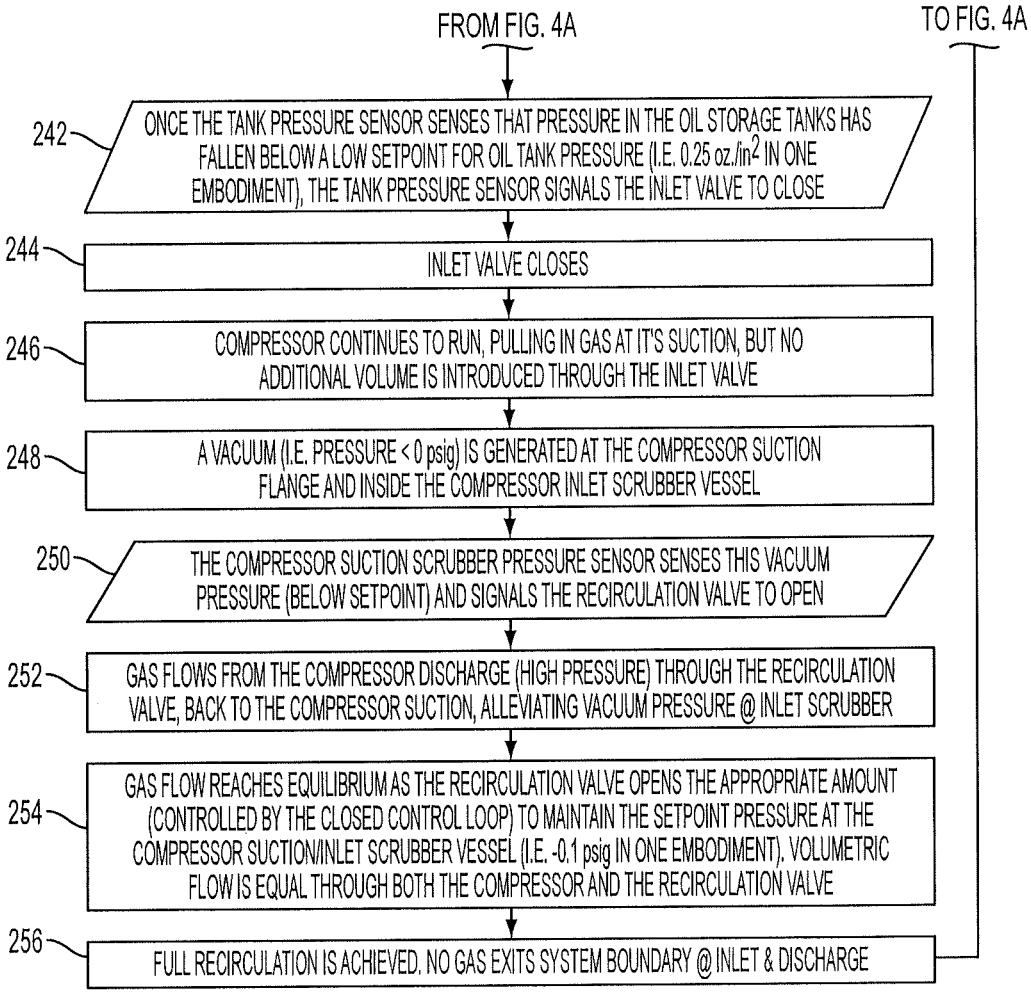
Figure 5:
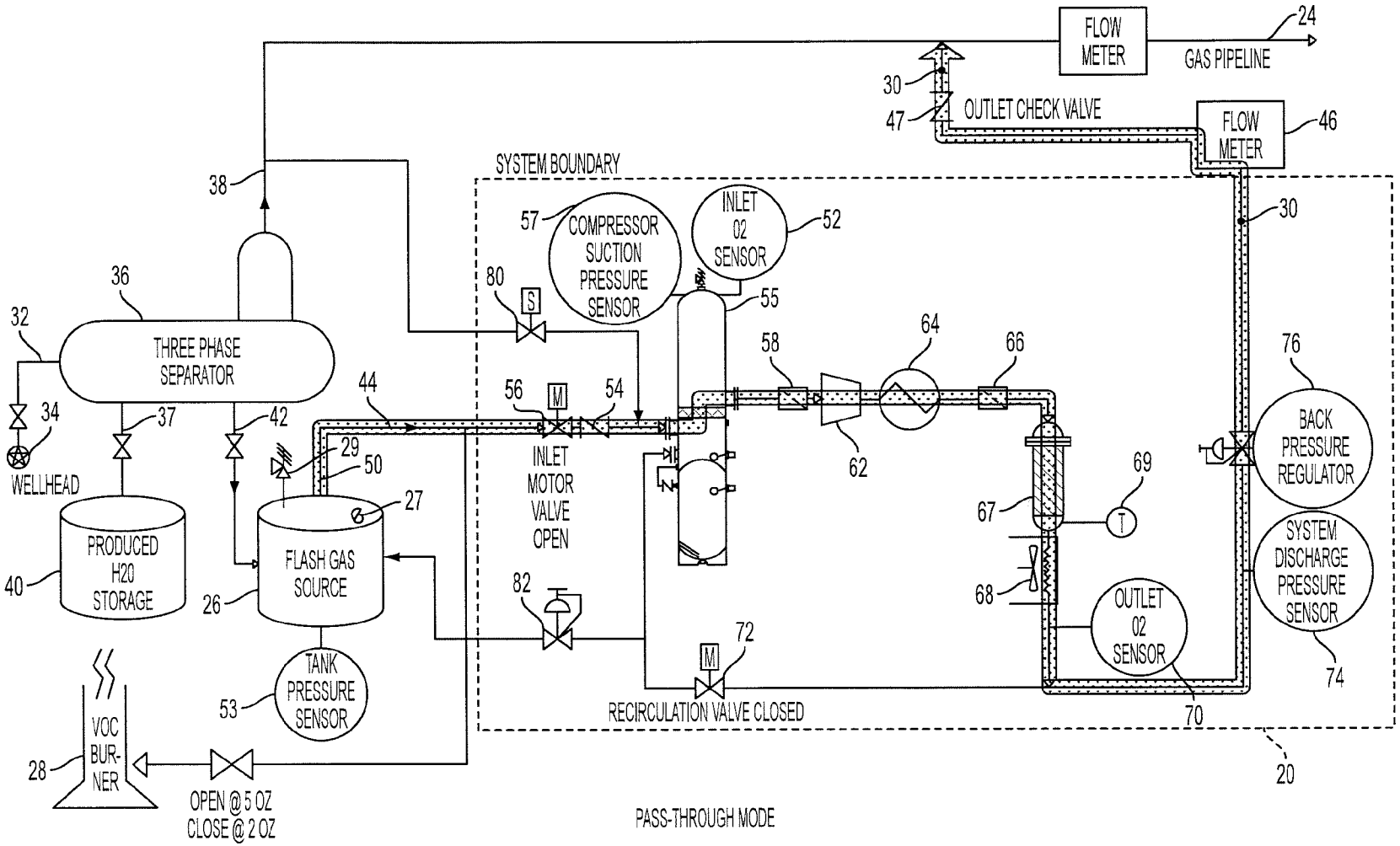
FIG. 5 illustrates an example of a vapor recovery system operating in a pass-through mode, in accordance with one embodiment of the present disclosure.
Figure 6:
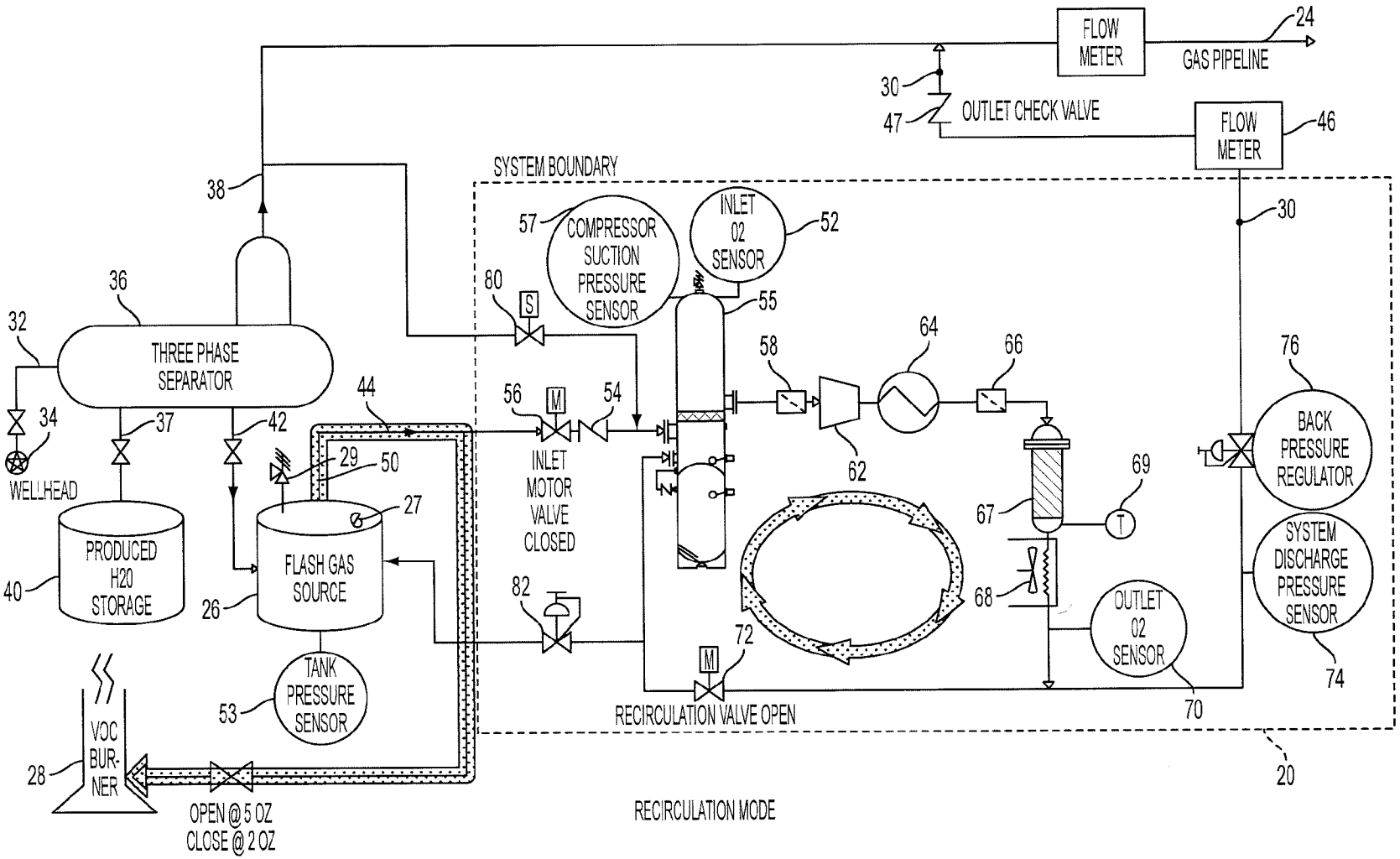
FIG. 6 illustrates an example of a vapor recovery system operating in a recirculation mode, in accordance with one embodiment of the present disclosure.

Referring to FIGS. 1-8, disclosed herein is a system 20 for recovering flash gas 44 from at least one flash gas source 26. In one embodiment, the system 20 may include a controllable inlet valve 56 having an input in fluid communications with the flash gas source 26 to receive the flash gas 44, the inlet valve 56 having an output; a compressor 62 having an input in fluid communications with the output of the inlet valve 56 to receive the flash gas 44 when the inlet valve 56 is open, the compressor 62 compressing the flash gas 44 to form compressed gas 30, the compressor 62 providing compressed gas at an output; a controllable recirculation valve 72 in fluid communications with the output of the compressor 62 and the output of the inlet valve 56; and a controller 60 electronically coupled with the inlet valve 56 and the recirculation valve 72, the controller 60 selectively controlling the inlet valve 56 and the recirculation valve 72 between i) a pass-through mode wherein the inlet valve 56 is open and the recirculation valve 72 is closed (see FIG. 5 showing an example of pass-through mode), and ii) a recirculation mode wherein the inlet valve 56 is closed and the recirculation valve 72 is open and no flash gas 44 enters the system 20 from the flash gas source 26 and no compressed gas 30 exits the system 20 in the recirculation mode (see FIG. 6 showing an example of a recirculation mode).

In one example, the system 20 may also include a pressure sensor 52 measuring a pressure of flash gas 44 in the flash gas source 26, wherein the controller 60 activates the pass-through mode when the pressure sensor 53 detects pressure within the flash gas source 26 that is above a desired set point. The controller 60 may activate the recirculation mode when the pressure sensor 53 detects pressure within the flash gas source 26 that is below a desired set point.

In one example, the system 20 may also include a pressure sensor 57 measuring a pressure of suction at the input of the compressor 62, wherein the controller 60 activates the pass-through mode when the pressure of suction is above a desired set point. The controller 60 may activate the recirculation mode when the pressure of suction at sensor 57 is below a desired set point.

In one example, the system 20 may also include an outlet pressure sensor 74 measuring an outlet pressure at the output of the compressor 62, wherein the controller 60 activates the pass-through mode when the outlet pressure is below a desired set point. The controller 60 may activate the recirculation mode when the outlet pressure at sensor 74 is above a desired set point.

In one example, the system 20 may also include an inlet oxygen sensor 52 measuring an oxygen content level of the flash gas 44 at the input of the compressor 62, wherein the controller 60 activates the pass-through mode when the oxygen content level is below a desired set point. The controller 60 may activate the recirculation mode when the oxygen content level at sensor 52 is above a desired set point.

In one example, the system 20 may also include an outlet oxygen sensor 70 measuring an oxygen content level of the compressed gas 30 at the output of the compressor 62, wherein the controller 20 activates the pass-through mode when the oxygen content level of the compressed gas is below a desired set point. The controller 60 may activate the recirculation mode when the oxygen content level of the compressed gas 30 is above a desired set point.

In one example, the inlet valve 56, the compressor 62, the recirculation valve 72 and the controller 60 are positioned on a platform/skid 84, and when the system 20 is operating in recirculation mode, no flash gas 44 enters the system 20 from the flash gas source 26 and no compressed gas 30 exits the system 20.

In one example, the system 20 may also include an oxygen reduction subsystem 67 receiving the compressed gas from the compressor 62, the oxygen reduction subsystem 67 reducing an amount of dioxygen contained within the compressed gas 30.

Other components, devices, subsystems, connections, configurations, features and operations of recovery system 20 are possible, depending upon the particular implementation, as shown in greater detail in FIGS. 1-8. It is understood that embodiments of the present disclosure could include greater or fewer components, devices, subsystems, connections, configurations, features and operations than are shown in FIGS. 1-8.

Figure 8:
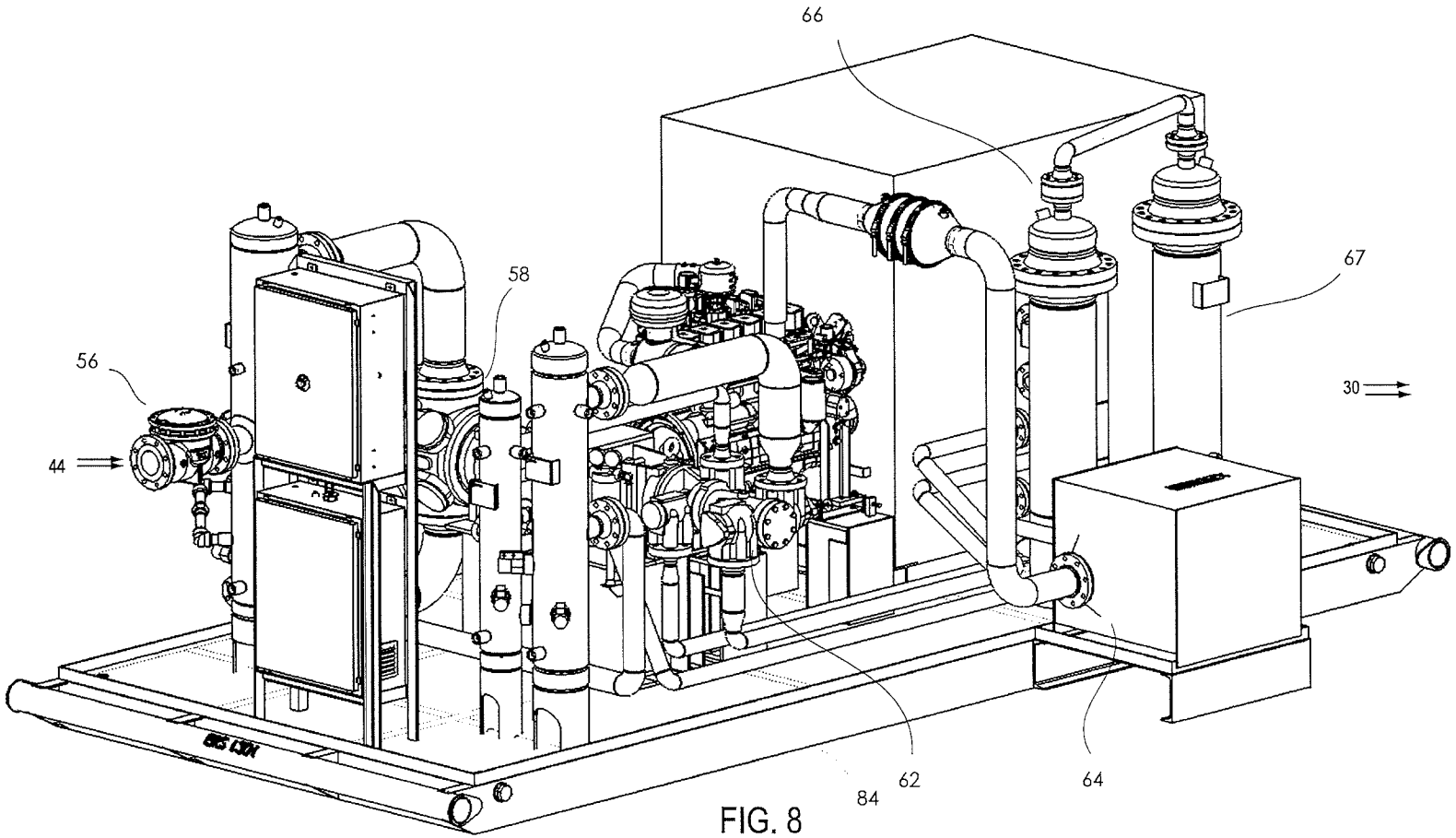
FIG. 8 illustrates an example of a vapor recovery system positioned on a platform or skid 84, in accordance with one embodiment of the present disclosure.

As shown in FIGS. 1-8 and as described herein, various embodiments of a hydrocarbon vapor (i.e., natural gas) recovery system 20 are disclosed. As described herein, embodiments of the disclosure provide for safe, efficient, and reliable recovery of substantial amounts of hydrocarbons and natural gas present in vent gas emissions. Referring to FIG. 1, an example of a vapor/gas recovery system 20 is illustrated in accordance with one embodiment of the present disclosure. The system 20 may be coupled with one or more flash gas sources 26, such as oil/condensate storage tanks or other sources of flash gas or fugitive emissions, and may also be coupled with a gas pipeline 24 (also interchangeably referred to as the sales line, gas sales line, or gas gathering line) through a flow meter 46 (optional). In one example and as described in greater detail herein, the recovery system 20 may include an inlet valve 56, a tank pressure sensor 53, a compression suction pressure sensor 57, an inlet oxygen sensor 52, a scrubber 55, a flame arrestor 58, a compression system 62 (which may include one or more compressors or stages of compression), a heating system 64, and an oxygen reduction system 67. A cooler 68 (that exchanges heat with another medium such as engine coolant or air, for example) may be coupled with the output of the oxygen reduction system 67 as well as between stages of compression 62, as needed. An outlet oxygen sensor 70 may be provided, as well as a system discharge pressure sensor 74. A recirculation valve 72 (also interchangeably referred to herein as a recirculation control valve) may also be provided as described herein, which selectively and controllably recirculates gas from the output of the system (or a point near the system output) to the input of the system (or a point near the system input). A make-up gas valve 80 can be included to supply additional gas volume for injection into system 20, such as for example immediately upstream of compressor 62 inlet/suction. A back pressure regulator 76 may optionally be provided to elevate or maintain the effective system discharge pressure. The system 20 may include a processor, controller, PLC or other logic 60, which may be coupled with various sensors (such as tank pressure sensor 53, compression suction pressure sensor 57, inlet oxygen sensor 52, outlet oxygen sensor 70, system discharge pressure sensor 74) as well as with the various controllable valves (such as inlet valve 56, recirculation valve 72, make-up gas valve 80, and depressurization valve 82) to control the operations of the recovery system. An engine (not shown) may also be utilized to drive the compressors 62, and an alternator (not shown) may be coupled with the engine to convert mechanical energy into electrical energy for charging a battery (not shown) or for providing other electrical power for system 20. The components of system 20 can be positioned on a skid or platform 84 as shown in FIG. 8.

The inlet valve 56 in one embodiment, is operated and controlled by controller 60 in response to changes in oil tank pressure 53, and can initiate entry of the system 20 into on-skid recirculation mode. In one example, the valve 56 is either open or closed. In another example, the inlet valve 56 can be controlled to be partially open based on various input conditions and control schemes. When the inlet valve 56 is open, hydrocarbon gas 44 is allowed to enter the recovery system 20, and when the inlet valve 56 is closed, gas 44 is prevented from entering the system 20.

In one example, as shown in FIG. 1, the piping before the inlet valve 56 is connected to one or more oil/condensate storage tanks 26, and the piping after the inlet valve 56 is connected to the inlet scrubber 55 immediately upstream of the initial compression stage 62. As hydrocarbon gases/vapors 44 are produced from oil condensate storage tanks 26 through flash losses, working losses, standing losses, and breathing losses, where liquid hydrocarbons evaporate into gaseous form, the inlet valve 56 either allows gas to enter the hydrocarbon gas recovery system 20 (i.e. during pass-through operation), or prevents this gas 44 from entering the recovery system 20 (i.e. during recirculation operation) in one embodiment.

In the example of FIG. 1, hydrocarbon recovery system 20 is connected with one or more condensate storage tanks 26 (with a thief hatch 27 and relief valve 29), a flare 28, and a sales gas pipeline 24 to provide recovered vapor 30 to the sales gas pipeline 24.

As fluids (i.e., oil, gas, and/or water) 32 are produced from production wells 34 and brought to the surface by sufficient reservoir pressure or by means of an artificial lift (not shown, i.e. plunger lift), such oil/fluids 32 are introduced into a separator 36 (such as a three-phase separator), which separates three components of the liquid flow 32 from the wellhead 34—natural gas 38, oil 42 and water 37. Most natural gas wells 34 produce natural gas and liquids, including liquid-phase hydrocarbons and water. Liquids are removed from the produced stream 32 by a separator 36 immediately downstream of the production wellhead 34. The separator 36 separates liquid $H_2O$ (shown as 37) and sends it to water vault(s) 40, while liquid hydrocarbons (also known as oil condensate 42) are sent to large oil condensate storage tank(s) 26 that typically maintain pressures from atmospheric pressure to 1 psig. The separator 36 also sends the natural gas 38 to the sales pipeline 24 for further conventional processing downstream.

The separator 36 typically operates at sales pipeline pressure which can typically range from 20 psig to over 500 psig, significantly higher than atmospheric pressure. The storage tank 26 is typically at a much lower pressure, typically between 0 to 1 psig, with 1 psig being a maximum allowable working pressure for many oil condensate storage tanks 26. Accordingly, as oil 42 moves from the separator 36 to the storage tank 26, vent gases/vapor emissions 44 are created (the terms vent gas, vent gas emissions, vent gas vapor emissions, flash gas, emission vapors, flash emissions, vapor, emissions, and combinations thereof are used interchangeably herein).

In one example, the inlet of the recovery system 20 is plumbed in parallel with inlet(s) of the flare(s) 28, with both the vapor recovery system 20 and flare(s) 28 downstream of the storage tanks 26 so that the recovery system 20 can capture the vent gas emissions 44 and convert such vent gas emissions 44 to recovered vapor 30 to be sent to the sales pipeline 24. If needed, the flare 28 can also incinerate vent gas emissions 44 under certain circumstances, described below, for instance when the volume of vent gas emissions 44 surpasses the capacity of the recovery system 20, or when vent gas emissions 44 are contaminated with excessive oxygen/air. A flow meter 46 and outlet check valve 47 can be provided in-line with the output of the recovery system 20, where the flow meter measures the amount of recovered vapor 30 and the check valve 47 prevents gas from the sales line from entering the output of system 20.

As shown in FIG. 1, in one example, from the one or more tanks 26, a manifold 50 is provided connecting the one or more tanks 26 to the suction of recovery system 20 though controllable inlet valve 56, and, in one embodiment one or more oxygen sensors 52 detect the oxygen content of the gas/vapor 44 at the inlet to the recovery system 20.

A pressure sensor 53 measures the pressure of the vent gas 44 at the inlet to the system 20, which effectively is a measurement of the pressure in the tanks 26. The oxygen sensor 52 can be used to provide a safety mechanism, in that vent gas emissions 44 which are determined to be excessively rich or high in oxygen content can be burned off at the flare 28 and not recovered by the system 20. Stated differently, one example of recovery system 20—through the use of the inlet oxygen sensor 52—detects whether the vent gas emissions/vapors 44 are contaminated with excessive amounts of oxygen/air (i.e., more than 3% concentration by volume or more depending upon the implementation). If so, the inlet valve 56 closes, which has the effect of sending the recovery system 20 into full recirculation mode, as described herein, and these highly-contaminated vent gas emissions 44 are subsequently incinerated by the flare 28.

In one example, if the controller 60 (see FIG. 2) determines that the flash emissions 44 are not contaminated with excessive oxygen/air (i.e., less than 3% concentration in one embodiment), then the inlet valve 56 opens, allowing the flash emissions 44 to be recovered by the recovery system 20.

Referring to FIG. 1, at the input to recovery system 20, the gas 44 is either directed to the burner 28 for incineration or to enter recovery system 20 through the series of inlet valve 56 (which can be a motor valve), check valve 54 (which can be a swing-type check valve), and a flame arrester 58. The opening or closing of inlet motor valve 56 is under the control of controller 60 (such as Programmable Logic Controller (PLC) 60 shown in FIG. 2) as described herein. When inlet motor valve 56 is open, gas 44 enters a compression system 62 (described below and may include, in one example, a series of scrubbers 55 and compressors) where the gas 44 is compressed and then heated through heating system 64, in one example of this disclosure.

After the gas 44 is heated by heating system 64, the gas 44 passes through another flame arrester 66 that quenches any flames that could propagate back or upstream, and then may enter, in one example, an oxygen removal subsystem 67, described in greater detail below, which can include one or more reactors or vessels which remove or reduce oxygen (e.g., dioxygen $O_2$) from the gas stream. Oxygen reduction system or sub-system 67 reduces amounts of diatomic oxygen (also known as $O_2$ or dioxygen) from the recovered gas, thereby preventing concentrated oxygen from entering the sales gas pipeline 24. As used herein, embodiments of the disclosure will be described as removing "oxygen" from the recovered gas or testing the "oxygen" concentration in recovered processed gas, and it is understood that this includes the testing and removal of diatomic oxygen (also known as dioxygen and $O_2$) from the recovered gas. In this regard, as used herein the term "oxygen" includes diatomic oxygen, dioxygen and $O_2$. An example of an oxygen reduction system 67 is described in co-pending U.S. patent application Ser. No. 14/286,983 entitled "Hydrocarbon Vapor Recovery System with Oxygen Reduction" filed May 23, 2014 the disclosure of which is hereby incorporated by reference in its entirety.

A cooler 68 (such as an sir cooled or water cooled heater exchanger) may be coupled with the oxygen removal system 67 to cool the gas exiting from the oxygen removal system 67.

An outlet oxygen sensor 70 monitors and detects the oxygen concentration level present in the gas exiting the oxygen reduction system 67. A recirculation valve 72 is coupled between the output of the system 20 (such as, in one example, valve 72 receives processed gas from oxygen removal system 67) and an input to system 20 (such as, in one example, valve 72 when open provides processed gas back into scrubber 55).

The gas output 30 from the oxygen reduction system is either, under the control of controller 60, passed to the sales pipeline 24 by closing recirculation valve 72, or internally recirculated by opening recirculation valve 72 (which is also under the control of controller 60). During full recirculation, inlet motor valve 56 is 100% closed in one example. However, if a lesser volumetric flow rate of gas enters the recovery system's inlet motor valve 56, when compared to the compressor's capacity at a given operating speed, the recirculation valve 72 partially opens to provide volume in order to maintain a set pressure in the 1st-Stage inlet suction scrubber vessel 55. The proper amount of recirculation valve 72 lift is determined by the controller 60 closed control loop (which can be a PID or PI loop as described herein).

A system discharge pressure sensor 74 and a back pressure regulator 76 can also be provided and coupled along the output of system 20, as described herein.

A make-up gas valve 80 can be coupled between a system inlet (such as coupled with an input to scrubber 55), and the gas line output of separator 36. The make-up gas valve 80 can provide gas 38 into the system 20 as described herein.

A depressurization valve 82 can be coupled between the output of the recirculation valve 72 and an input into tanks 26, to provide depressurization of the system 20, as described herein.

In one example, various conditions can cause controller 60 to place recovery system 20 into a recirculation mode (by closing inlet motor valve 56 and opening recirculation valve 72) that recirculates gas 44 internally within recovery system 20 in such a way that all gas volume that passes through the compressor is supplied by the recirculation line alone such that no gas volume enters through the inlet valve 56 of recovery system 20: i) if there is low pressure upstream of the inlet check valve 54 (as measured by pressure sensor 53) being drawn off of the oil tanks 26 (such as, by way of example, a positive pressure of 0.25 oz/in$^2$ or less, which indicates that there is little or no vent gas 44 in the tanks 26), ii) if there is too much oxygen detected by O2 sensor 52 in the gas 44 present at the inlet of system 20 (such as, by way of example, an oxygen concentration of greater than 3 percent in one example), iii) if there is too much oxygen detected by outlet oxygen sensor 70 at the outlet of the system 20 (such as, by way of example, an oxygen concentration of greater than 10 ppm), or iv) if the pressure measured at either the final stage of compression discharge or reactor gets to be close to the high-pressure shut down setpoint (i.e., within 20 psi in one example), which could be caused by a blockage or freeze in the sales pipeline 24—if any of these conditions occur, then the gas present at the outlet of recovery system 20 is recirculated through recirculation valve 72 back into the inlet of recovery system 20. If none of these conditions are present, then the recirculation valve 72 is fully closed by controller 60 and the gas 30 at the outlet of system 20 (in one example, exiting from oxygen reduction system 67) is not recirculated through system 20 and is instead passed to the sales pipeline 24 through flow meter 46 and outlet check valve 47.

As recognized by the present inventors, on-skid recirculation of system 20 may be achieved via precise control of the gas/vapor pressure at the compressor suction 57. Pressures too high can damage the compressor 62 by loading the piston rods higher than they can safely withstand without buckling. Pressures too low can also be disadvantageous because this would result in lower volumetric efficiencies of the compression cylinder(s), meaning less gas is pumped through the compressor 62. This will also not force the system's engine (not shown) to work as hard, thus producing less heat in the engine exhaust stream, which is beneficial when coupled with an oxygen removal process. Additionally, a vacuum condition can have adverse effects on a forced feed cylinder lubrication system if present.

With an example of the present disclosure, modulating between pass-through and recirculation operating modes, as well as primary driver (i.e. engine) rotational speeds if desired, provides the ability to control pressure at the upstream flash gas source 26 (i.e., Oil Storage Tanks) to a very low and precise pressure (i.e. 0.25 oz/sqin in one embodiment).

In one example, embodiments of the present disclosure may utilize various components for providing the above-described modes of operation. For instance, an inlet valve 56, recirculation valve 72, compressor 62, compressor suction pressure sensor 57, and upstream production tank pressure sensor 53 can be utilized.

A controller, processor, programmable logic controller (PLC), computing device or other logic 60 can include one or more inputs and outputs, and can also include programs, modules, operations to control the vapor recovery system 20 based on the one or more operations or conditions described herein and can be configured to implement one or more of the features or functions disclosed herein.

Figure 3:
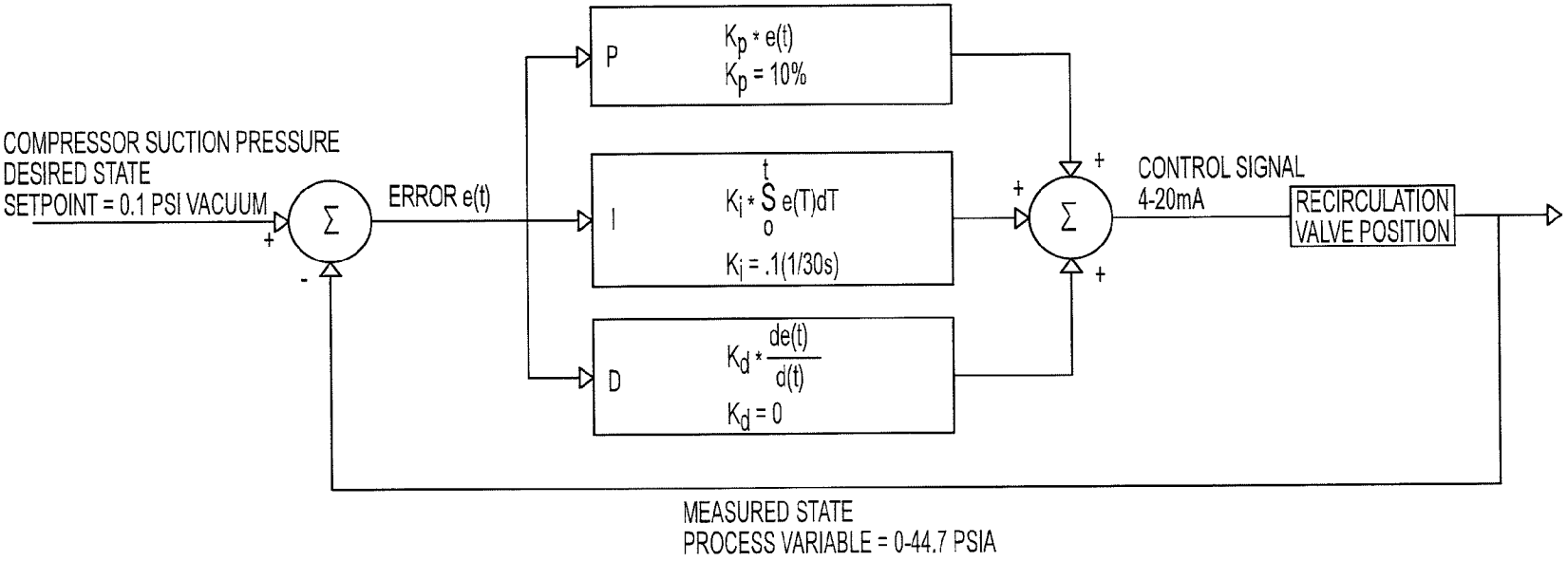
FIG. 3 illustrates a block diagram of an example control system for controlling the position of a recirculation valve 72 of a vapor recovery system, in accordance with one embodiment of the present disclosure.

In one example, the inlet valve 56 can be controlled discretely (open or closed) in one embodiment. The recirculation valve 72 can be controlled via a closed control feedback loop with a Process Variable and Set Point both associated with the gas pressure at the compressor suction/inlet in one embodiment, such as shown in FIG. 3). The compressor 62 can be an engine-driven, multi-stage, reciprocating compressor in one embodiment. It is noted that the recirculation valve 72 could be implemented using multiple valves in parallel opening sequentially; or one valve opening and closing rapidly as needed.

The compressor suction pressure sensor 57 can be located just upstream of the initial compression stage 62, for instance on the initial compression stage inlet scrubber 55 in one embodiment, and this sensor may send a Process Variable (PV) signal to a closed loop controller 60. In one example as shown in FIG. 3, when the pressure (process variable) that this sensor 57 senses is lower than the desired pressure (set point), a closed feedback control loop with proportional, integral, and derivative components sends a signal (control output) that proportionally opens the recirculation valve 72, which is located between the high-pressure discharge and low-pressure suction sides of the compressor. The amount that the recirculation valve 72 opens, in conjunction with the pressure differential across the recirculation valve 72, corresponds to the flow rate of gas through the recirculation valve 72. This flow rate provides volumetric flow rate from the compressor discharge back to the suction side, allowing the system to recirculate gas in a controlled manner. The closed-loop controller determines the proper amount of valve lift of the recirculation valve 72 to maintain the desired pressure (set point) at the suction side of the initial stage of compression. At equilibrium, the flow rate at the compressor suction pressure sensor approximately equals the flow rate at the compressor discharge, which also is approximately equal to the flow rate through the recirculation valve 72.

The upstream production tank sensor 53 can be located upstream of the inlet valve 56, and can send a signal to the PLC 60 and may also provide one of the inputs (FIG. 2) for the open loop control of the inlet valve 56.

Other components may also be utilized in other embodiments. For instance, an unloader valve (not shown); cooler/air heat exchanger 68, oxygen reduction system 67 and/or exhaust gas heat exchanger may also be utilized in some embodiments. The unloader valve, which allows the compressor 62 to recirculate, free of restriction with under minimal load to the primary driver (i.e. engine in one embodiment), can be placed in parallel to the recirculation valve 72 controlled discretely (open or closed). It is possible, in one embodiment, to have the recirculation valve 72 act as an unloader valve if properly sized. The cooler/air heat exchanger 68 may be located downstream of the last stage of compression 62 (and/or downstream of the reactor(s) 67 in one embodiment) and upstream of the recirculation valve 72. The cooler/air heat exchanger 68 can be provided so that the temperature of the gas is down to an acceptable level before it passes through the recirculation valve 72, which thereby protects the Recirculation Control Valve from damage.

The oxygen reduction system 67 may be provided in some embodiments to reduce or remove oxygen from the recirculating gas stream, and examples of oxygen reduction systems, as well as components of vapor recovery systems, are described in co-pending patent applications, cross referenced above.

For instance, an exhaust gas heat exchanger 68 may be provided to draw heat from the engine exhaust gas to heat the recirculating gas line, thereby increasing the process gas temperature to assist in the oxygen removal reaction inside the reactor(s) 67 immediately downstream. One or more reactor vessel(s) 67 may be provided and filled with catalyst beds that facilitate removal of oxygen from the recirculated gas stream. An inlet/suction oxygen concentration analyzer 52 (% range in one embodiment) may be provided to detect the concentration of oxygen in the gas entering the compressor. If the oxygen concentration is found to be too high, sensor 52 may send a signal to controller 60 which can close the inlet valve 56, which, in turn forces the system into recirculation. An outlet/trace oxygen concentration analyzer 70 may be provided to detect the concentration of oxygen in the gas exiting the reactor vessel(s) 67, and if the concentration of oxygen is found to be too high, sensor 70 may send a signal to controller 60 which may close inlet valve 56, which, in turn forces the system into recirculation.

In some embodiments, inlet scrubber 55 may include a blow case. In one embodiment, a blow case in fluid communication with the compressor inlet scrubber vessel 55 can assist in the evacuation of scrubbed liquids from within the scrubber vessel 55. While a scrubber that operates at higher pressures (i.e. >35 psig) will not encounter this problem, if the condition exists such that gas exists at a relatively low pressure within the scrubber vessel 55 (i.e. the pressure typically found within an oil storage tank, <1 psig), sufficient pressure will not exist within the scrubber vessel to force liquids out of the scrubber vessel when the associated liquids dump valve opens. To ensure liquids can be evacuated from the scrubber vessel and prevent a high liquid-level condition, a blow case may be included as a separate vessel, or can be incorporated as a separate, lower section of the scrubber vessel 55. In either case, the blow case will be physically located below the scrubber vessel 55 to allow the liquids to drain from the scrubber vessel 55 into the blow case via gravity. In one embodiment, liquids are dumped back to the oil storage tanks 26, and multiple lines (i.e., four lines) can be connected to the blow case: a liquids drain line with a check valve placed between the scrubber vessel 55 and blow case that allows flow in the direction to the blow case from the scrubber vessel, a pressure equalization line, a pressurized gas supply line, and a dump line. During normal operation, where the liquid level inside the blow case is below a desired level, which can be measured by the float of a dump-valve controller in one example, collected liquids drain from the scrubber vessel 55 into the blow case via the drain line while the check valve ensures no reverse flow. The pressure equalization line allows gas from the head space of the blow case to flow upwards into the scrubber vessel 55, replacing volume inside the scrubber vessel 55 and ensuring no relative vacuum condition is generated that could prevent liquids from draining into the blow case. Once the float of the dump-valve operator rises to a set position by floating on top of the rising liquid level, the dump-valve operator opens the dump valve, closes the pressure equalization line, and opens the pressurized gas supply line. This increases the pressure within the blow case, forcing liquids out through the dump line. A closed pressure equalization line and the drain line's check valve prevent any reverse flow of liquids from the blow case back into the scrubber vessel. Once the float of the dump valve operator returns to a low position, the dump valve closes, the pressurized gas line closes, and the pressure equalization line opens, allowing newly scrubbed and collected liquids to drain into the blow case once again.

As described herein, in one example, the system 20 is selectively placed into recirculation mode or pass-through mode by the controller closing or opening inlet valve 56, respectively. Closing inlet valve 56 can occur, in one example, under one or more of the following conditions: high oxygen concentration at the inlet; high temperatures within the reactor vessel(s) 67—a condition driven by high concentrations of oxygen at the inlet due to the exothermic nature of the catalytic oxygen removal reaction (i.e., >3% oxygen concentration of the flash gas stream); high oxygen concentration at the discharge/outlet 70; low pressure at the flash gas source/oil storage tanks (upstream of inlet valve 56) as measured by sensor 53; high pressure at the discharge/outlet sensor 74; or the inlet valve 56 may be closed in order to adjust the volume capacity. For instance, in some embodiments, the inlet valve 56 can be opened/closed in succession, or partially closed, to 'choke' the inlet stream, and thereby the volumetric flowrate of the system would be 'throttled' or reduced from its full capacity.

Alternatively, the recovery system 20 can be selectively transitioned from recirculation mode into a pass-through mode by the controller by directing opening of the inlet valve 56, even during the presence of triggers that would otherwise require recirculation mode. Forcing the inlet valve 56 open, despite the presence of one or more signals that normally would call for recirculation can occur, in one example, to maintain a desired pressure downstream of the compressor 62. This pressure can be, in one embodiment, below the current pressure of the gas pipeline, ensuring that recovered gas is not delivered to the pipeline until desired (i.e. no conditions calling for recirculation mode are present). This desired pressure, in one embodiment, is, at a minimum, high enough to drive a flow rate through the recirculation valve 72 that is equal to the flow rate of the compressor's volumetric throughput when the recirculation valve 72 is fully open.

When controller 60 closes the inlet valve 56 to place the system 20 into a recirculation mode as described herein, this recirculation mode can have various desirable effects. In one example, closing the inlet valve 56 allows the system temperature, especially at/inside the reactor vessels 67 (if and when used), to rise to the desired temperatures as the system is starting up; and this prevents the system 20 from pushing gas through the system boundary/gathering pipeline before the oxygen removal reaction has begun.

Closing the inlet valve 56 may also prevent too much oxygen in the gas stream 44 from entering the system 20 if the oxygen concentrations in the gas stream 44 are too high as detected at the inlet 52 (i.e. over 3% in one embodiment), as high levels of oxygen concentration could potentially create an unsafe condition. For instance, one condition can be an explosive mixture of oxygen and gas/vapor that could potentially auto-ignite inside the compressor 62 (similar to a diesel engine) which would be destructive towards the compressor 62. Closing the inlet valve 56 at an inlet oxygen concentration set point that is well below explosive or flammable concentrations would prevent too much oxygen from being introduced into the system 20. Another condition would be having too much oxygen in the gas stream 44 that could potentially overheat the reactor vessel(s) 67 if and when used. Because the oxygen removal process is exothermic, more oxygen in the process gas results in more oxygen combustion, and more combustion equates to higher temperatures. Closing the inlet valve 56 at an inlet oxygen concentration set point that is below a concentration that could potentially overheat the reactor vessel 67 or its contents would prevent introduction of enough oxygen that could cause this adverse situation. Oxygen will continuously be removed while the inlet valve 56 is closed during recirculation mode, which should reduce the temperature rise across the reactor 67 before more oxygen is introduced.

Closing the inlet valve 56 also stops the inflow of gas 44 from the flash gas source (i.e., oil storage tanks) 26, which will prevent a vacuum condition from being generated at said tanks 26 if the tank pressure is close to zero.

Closing the inlet valve 56 can also prevent a high pressure shutdown. If there is a line blockage in the gas gathering pipeline 24 (i.e. line freeze or closed valve), closing the inlet valve 56, once the discharge pressure 74 reaches a point below but near that of a high pressure shutdown, will prevent further gas from being introduced inside the system boundary, which also prevents further pressure build up. This can be particularly useful in cold weather conditions because the compressor engine can remain on and the system temperature, especially of reactor vessels 67, remains elevated. Starting the engine/compressor 62 (or any rotating equipment) is more difficult in cold weather. Also, line blockages are more common in cold weather they are usually due to a frozen section of pipe.

The recirculation valve 72 can be electronically controlled by controller 60, or directly actuated by pneumatic gas, including a current-pressure (IP) converter implemented within controller 60. In one example, the recirculation valve 72 is positioned and connected downstream of the final stage of compression 62 (and can be positioned and connected downstream of heat exchangers 64 and oxygen removal reactor vessel(s) 67 in one example) and upstream of the initial stage of compression's inlet suction scrubber 55.

As described below with reference to FIG. 3, the IP converter that controls the recirculation valve 72 may be controlled by the output of a Proportional-Integral Closed Loop Controller (PID) inside the PLC 60, in one embodiment. The input (i.e. process variable) into the PID loop is received by the PLC 60 from the compressor suction pressure sensor 57 and the desired pressure within the compressor's initial stage suction inlet scrubber, i.e. PID Set Point, may be manually set by the operator. In one embodiment, this set point is slightly below atmospheric pressure (i.e. 0.1 psig vacuum). A back pressure regulator 76 may be coupled with in the recirculation line, just downstream of the recirculation valve 72 in one embodiment. This regulator 76 is used to bleed pressure into a bypass/dump line when pressure exceeds the back pressure regulator's 76 set-point (i.e. 5 psig in one embodiment). In the case of needing to depressurize/blow-down the unit 20, this regulator 76 bleeds material into the liquids dump line (which can be connected to the oil tanks 26 in one embodiment) prior to it entering the inlet scrubber 55.

The recirculation valve 72 can stand alone, or can in another embodiment be placed in parallel with an unloader valve (not shown) that has a comparatively larger valve seat so that the recirculation valve 72 does not have to handle the unloading or depressurization of the system. By incorporating an unloader valve, the system is able to unload faster (and potentially more completely during operation or startup, in one embodiment).

By appropriately controlling the amount the recirculation valve 72 opens, pressure is kept steady in the first stage inlet scrubber 55 to allow the unit 20 to run at as close to steady-state conditions as possible. The pressure at sensor 57 that it maintains may be set by the operator where, in one embodiment, the pressure is set to 0.1 psig vacuum. In one example, this may be accomplished by a method where the PLC receives a signal of the process variable from the pressure sensor 57 mounted between the compressor suction flange and the inlet valve 56 (on the inlet scrubber 55, in one embodiment). After receiving the pressure/Process Variable signal, the PID closed loop controller in the PLC 60 calculates the desired position of the recirculation valve 72 and sends the control Output as an electronic signal to the IP converter, which in one example can translate that electric current signal to a corresponding gas pressure and actuates the recirculation valve 72 accordingly.

The recirculation valve 72 can be operated, in concert with the inlet valve 56, in a manner to maintain pressure throughout the system 20. By controlling the recirculation valve 72 to a fully closed position, gas is no longer able to recirculate from the high pressure side (i.e., discharge of final stage of compressor 62 in one example) to the low pressure side (i.e. inlet 55 or suction of the initial stage of compression) of the recirculation valve 72. By closing the recirculation valve 72, in conjunction with simultaneously opening the inlet valve 56, pressure can be built up throughout the system 20 while maintaining a proper pressure at the inlet scrubber 55 as it is in fluid communication with the flash gas source/oil storage tanks 26 through the open inlet valve 56. In one embodiment, the controller 60 reads a target final stage of compression discharge pressure at sensor 74, which, in recirculation mode, can be close to, but below, the pressure currently held in the gas gathering or sales pipeline 24 pressure in one embodiment. In one example, this target discharge pressure for recirculation mode, can be set by the operator, or calculated by the PLC 60 if a signal indicating the gathering pipeline 24 pressure is present. Upon the PLC 60 detection of a discharge pressure at sensor 74 that deviates too far below this target compressor discharge pressure, the PLC 60 signals to close the recirculation valve 72 while simultaneously signaling to open the inlet valve 56, allowing new flash gas 44 to enter the system inlet for compression, thus causing pressure to rise throughout the system 20. Once the target pressure is reached, the system 20 can once again continue in the mode it would normally be operating, either pass-through mode or recirculation mode, as dictated by a variety of conditions as described herein. The recirculation valve 72 determines when recovered gas 30 is sent to the sales line 24 versus being recirculated back through the system 20. If the recirculation valve 72 is fully closed, while the inlet valve 56 is in the open position and the compressor is operating, gas/material will be forced out of the system boundary and into the sales line 24 to leave the system 20 by overcoming the pressure at sales line 24. If the recirculation valve 72 is not fully closed, gas/material can travel through the recirculation valve 72, returning to the inlet of the initial stage of compression to again pass through system 20.

In one embodiment, if the oxygen content of the material/flash gas 44 is determined to be above specification immediately downstream of the oxygen removal reactor(s) 67 as observed by the outlet oxygen sensor 70, the PLC 60 will signal the inlet valve 56 to close. The compressor 62 continues to operate, but no new gas 44 is able to enter the system boundary (i.e. from the oil storage tanks 26 in one example) due to the closed inlet valve 56, thus generating a vacuum at the suction of the compressor 62, i.e. within the first stage inlet scrubber 55. As the PLC 20 PID (proportional, integral, and derivative) closed control feedback loop recognizes that the Process Variable (i.e., compressor's initial stage suction pressure 57) has dropped below the PID Set Point (i.e., 0.1 psig vacuum in one embodiment), the PID closed control feedback loop increases the value of the control Output, in turn proportionately increasing the opening of the recirculation valve 72 (via the current-pressure converter in one embodiment) until the proper opening is achieved to maintain the Process Variable (pressure at the suction of the first stage of compression) as close to the Set Point as possible.

In one embodiment, the recovery system 20 will remain in recirculation mode under certain conditions by maintaining the proper recirculation valve 72 opening with the inlet valve 56 closed, preventing oxygen-rich gas from entering the sales line 24 and allow the oxygen-rich gas more time within the system 20 (i.e. more contact time with the oxygen removing catalyst within the reactor vessels) until the oxygen has been removed. Once oxygen concentration of the flash gas 44 has been determined to be below the oxygen concentration specification (i.e. under 10 parts per million in on embodiment), this condition that triggers recirculation will no longer be present.

If the pressure in the oil storage tanks 26 is detected to be lower than desired (i.e. below 0.25 ounces per square inch in one embodiment), the PLC 60 will signal the inlet valve 56 to close, in turn generating a vacuum on the first stage inlet scrubber 55 as described herein. This will then cause the recirculation valve 72 to open as described herein so that the system 20 is able to remain in operation while not removing more vapor, and thus pressure, from within the vessel or container 26 that is in fluid communication with the inlet of the recovery system 20 than is necessary or is desired. In one embodiment, the operation of the recirculation valve 72 can be utilized to ensure the associated oxygen removal reactor(s) 67 maintains pressures and temperatures at which the oxygen removal catalytic reaction operates most efficiently. In one embodiment, this equates to greater than 300 psig and 400 degrees Fahrenheit at the reactor outlet. In one embodiment, the PLC 60 monitors the pressure within the reactor vessel(s) 67 and assesses if this variable is getting close to a high pressure condition at the discharge of the final stage of compression (for instance, at sensor 74) and if the high pressure discharge set-point is reached (i.e. 400 psig in one embodiment), the PLC 60 will cause the system 20 to shut down (i.e. stop the engine and compressor 62 from turning while simultaneously depressurizing pressurized gas held within the system boundary in one example). If the PLC 60 determines that discharge pressure at sensor 74 is nearing a high pressure condition (i.e. within 20 psi of the high pressure shut down set point), the PLC 60 will signal the inlet valve 56 to close while simultaneously signaling the recirculation valve 72 to open the appropriate amount as described herein, allowing the unit to stay running while not continuing to increase the discharge, because the flow of new gas 44 into the system boundary has been shut off by the inlet valve 56. As the recovered vapor with system 20 experiences the JT effect as it travels through the recirculation valve 72, the "heavy" or long-chained hydrocarbon constituents in the vapor mixture will drop in temperature causing them to condense to the liquid phase and drop out of the system 20 by collecting in the compressor's scrubber vessel(s) 55, from which they will exit the system boundary in one example through a liquids dump line where these liquids return to the oil storage tanks 26, thus lowering the pressure of the system.

If the PLC 60 determines that proper conditions (i.e., shut down signal) are present that require the compressor 62 (and associated driver, i.e., engine or motor) to stop operating/running, the system 20 in one embodiment can depressurize all gas from inside its piping, vessels, reactors, compressor cylinders, etc. before it can restart. The primary reason for this is that engine starter motors are not able to push against the force that would be present if the system were to remain pressurized. In one embodiment, this depressurization, or "blow-down," can be accomplished by opening the recirculation valve 72 a desired amount. This will allow pressure to equalize between the reactor/final stage of compression 62 discharge and the compressor suction inlet (i.e., compressor inlet suction scrubber 55). The equalized pressure will be above the depressurization back pressure regulator 76 set point, i.e. 5 psig in one embodiment. In one example, if all piping, vessels, equipment (i.e., blower or first stage cylinder) are rated for a pressure higher than what these components will experience when pressure stored within the system boundary is equalized, the recirculation valve 72 can be fully opened. In another example, if all piping, vessels, equipment are not rated for a pressure higher than what these components will experience when pressure stored within the system is equalized, another approach may be used besides fully opening the recirculation valve 72. One such method could be to change the Set Point of the Process Variable—compressor inlet suction scrubber pressure 57 in this case—of the PID closed control loop to a pressure that is lower than what the lowest pressure-rated piece of equipment is rated for, but high enough to provide enough motive force to push any liquids that may exist in the dump line back to the oil storage tanks 26, effectively depressurizing the system 20 in a way that does not expose any equipment to pressures above their ratings. In one example, this Set Point pressure for the PID closed control loop's Process variable is 25 psig.

Selective recirculation can allow the system to maintain elevated temperatures and pressures in oxygen removal reactor(s) by allowing the engine and compressor to continue to operate despite no new or additional gas 44 entering the system boundary. In one embodiment, pressures and temperatures are ideally maintained above 300 psig and above 400 degrees Fahrenheit. In one example, the engine and compressor 62 continue to operate during circumstances where the inlet valve 56 must be closed. This allows the compressor 62 to heat the gas it compresses via the heat of compression, and the engine can continue to operate, where its hot exhaust gases are routed through the heat exchanger, where heat is transferred into the flash vapor process stream, further elevating the vapor's temperature immediately upstream of the reactor vessel(s), allowing an efficient and effective oxygen removal process to occur in one example. Additionally, by continuing to operate the compressor 62 while in recirculation mode, the system is able to maintain pressurization as described herein. Assuming an abundance of flash gas 44 generation in the flash gas source 26, net material 30 sent to the sales line 24 is increased via selective recirculation because there are fewer startup periods or times when the unit 20 is unable to send material 30 to the sale line 24 due oxygen concentrations above the maximum sales pipeline specification, which can result from low reactor 67 temperatures and pressures.

In one example, when properly sized and operated while the system 20 is in recirculation mode, the recirculation valve 72 is used to/has the effect of cooling the recirculation vapor stream prior to its return back into the suction side of the first stage of compression 62. The gas experiences the Joule-Thomson (JT) effect across the valve as it experiences the drop in pressure from that of the final stage of compression, down to the pressure at the suction side of the system (which is maintained by the PID closed control loop logic). The vapor is cooled by approximately 120 degrees Fahrenheit in one embodiment. This keeps the compressor 62 components at a safe working temperature and protects them from unnecessary wear that these components could otherwise experience if the recirculation gas that is re-introduced to the suction side of the compressor is too hot. If the Joule-Thompson effect across the recirculation valve 72 does not provide enough cooling, additional cooling can be provided in the form of an air-cooled heat exchanger in one example.

In one embodiment, the recirculation valve 72 can be used as to throttle volumetric throughput of the entire system 20. This could be accomplished by opening the recirculation valve 72 to an amount equal to, or lesser than what would be required than the amount necessary for full recirculation, all while the inlet valve 56 remains open. This would have the effect of reducing the volumetric output of the compressor 62 because a portion of the gas processed through the compressor would be "recycled" gas—gas that had already been processed by the compressor 62 before being returned to the suction inlet from the discharge. The volumetric difference between that of the compressor's overall flow rate capacity and the volumetric flow rate of the recycled gas is the volumetric flow rate of "new" gas entering the system boundary. The flow rate of "new" gas would be equal to the flow rate of the overall compressor output at the discharge, although the output flow would not necessarily be the exact same molecules that entered the system boundary as the "new" gas does mix with the "recycled" portion. In one embodiment where oxygen concentration is measured downstream of the point where recovered gas from the storage tanks 26 is mixed or blended with traditional gas production that comes straight from the separator 36, this method of capacity control would be beneficial, especially if oxygen removal reactor(s) were not present on a given system with this capacity-control recirculation technology. In the case where oxygen levels are too high to meet an oxygen specification when blended with traditional gas production at a given site, the valve 72 could be partially opened to a position between full pass-through mode and full recirculation mode, allowing for some gas 30 to leave the system 20 at a lower volumetric rate while retaining the remaining gas in the system for recirculation. This would bring oxygen concentration on a blended-with-traditional-production basis down and allow the system 20 to continue producing recovered gas/material 30, albeit at a lower volumetric rate.

In one embodiment, the use of selective recirculation via the operation of the inlet valve 56 and recirculation valve 72 in concert as described herein in recirculation mode or pass-through mode can be used to maintain recirculation valve 72 at desired pressure levels within the oil storage tanks that are in fluid communication with the system inlet. If desired, the pressures within the tanks 26 can be kept extremely low. In one embodiment, they can be maintained at, for example, 0.25 ounces per square inch. Should pressure within the oil tanks 26 rise above the high window of the set point of the PLC 60 PID closed control loop (i.e. 1.50 ounces per square inch, in one example) the system 20 can enter into pass-through operation, effectively removing material/flash gas 44 from within the flash gas source/oil tanks 26. If the flow rate through the compressor 62, which is the flow rate of gas/material being removed from the tanks 26 in pass-through operation, is greater than the rate of flash gas 44 production within the tanks 26, the pressure within the tanks 26 will be reduced. Once pressure is reduced to below the low window of the set point (i.e. 0.25 ounces per square inch), the system 20 can enter recirculation mode, effectively shutting off the flow of gas 44 being removed from the tanks 26. As flash gas 44 continues to be produced within the oil storage tanks 26, the pressure will once again rise above the set point of the PLC 60 PID closed control loop, and the system 20 can once again enter pass-through operation mode, allowing the system to remove gas 44 from the tanks 26 again. This allows for safer operation of the well site by keeping dangerous vapors 44 from escaping into the atmosphere should pressures otherwise rise above the set point of any pressure relief valves 29 in fluid communication with the oil tanks 26. Similarly, by keeping the tank pressure low, the oil haulers have less chemical exposure when opening the hatches 27 during testing of oil levels in the tanks 26.

The inlet valve 56 is controllably opened or closed under control of the controller 60 depending on one or more input conditions or detected conditions.

In one example, the position of the inlet valve 56 can be controlled based on the concentration of oxygen present in the recovered gas 44 from the oil storage tanks 26. This concentration can be measured at both the inlet and outlet of the recovery system 20. In one example, the inlet valve 56 closes under the condition of high oxygen when measured at either, or both, the system inlet or outlet. If the oxygen concentration, when measured at the outlet sensor 70 of the oxygen removal reactor vessels 67, which can be measured in parts per million [ppm] in one embodiment, is determined to be above the target concentration of the resulting mixture of the recovered gas when blended with traditionally produced gas (i.e. 8 ppm in one embodiment, the inlet valve 56 will close, forcing the gas to recirculate through the system 20, by means of closed loop control of the recirculation valve 72 as described herein, until an acceptable oxygen concentration is achieved.

In one example, the inlet valve 56 closes under the condition of low tank pressure. If the pressure on the tanks 26 is below a certain pressure (i.e. 0.25 ounces per square inch in one embodiment) for a certain amount of time (i.e. 5 seconds in one embodiment), the inlet valve 56 will close. By closing and preventing further material/gas 44 removal from within the oil storage tanks 26 in fluid communication with the inlet of the recovery system 20, the system 20 prevents an unsafe environment by avoiding a vacuum condition in the oil storage tanks 26, which also prevents potentially high levels of oxygen at the inlet by sucking air into the tanks 26, as ambient air, which is rich in oxygen, can be pulled into the tanks when a vacuum condition is created because most oil storage tanks 26 are equipped with "vacuum break" valves which open when a vacuum condition is generated within the tanks 26.

In one embodiment, once the vapor space within the oil storage tanks 26 has reached a given pressure (i.e. 1.5 oz./sq. inch in one embodiment) for a certain amount of time (i.e. 10 seconds in one embodiment), the inlet valve 56 would be opened via a signal sent by the PLC 60. In one example, this pressure that triggers the inlet valve 56 to open and thereby initiate pass-through operation, can be set below the pressure that the flares 28 (positioned parallel to the vapor recovery system 20 on the flash gas line coming from the oil storage tanks 26) are set to start combusting flash gas 44, thereby allowing more material/flash gas to be processed, recovered, and sold into the gas gathering pipeline 24 through the recovery system 20 instead of burned at the flares.

The inlet valve 56 closes during condition of high discharge pressure. If the discharge pressure at sensor 74 reaches the high window of high pressure shut down avoidance, slightly below the high pressure shut down set point (i.e. 380 psig with 400 psig as the high pressure shut down set point in one embodiment), the inlet valve 56 will close, thereby placing the system 20 into recirculation mode and preventing further vapor 44 from being recovered and preventing further build-up of pressure at the discharge sensor 74. By preventing further pressure rise at a pressure that is below the high pressure shut down set point, the system 20 can continue to run while avoiding a condition would otherwise shut down the system. Once the system discharge pressure at sensor 74 drops below the low window of high pressure shut down avoidance (365 psi in one embodiment), the PLC 60 will signal the inlet valve 56 to open again, in one example. A possible reason that could cause a discharge pressure to drop includes material/processed gases leaving the system boundary in liquid form through a liquids dump line via condensation formation via Joules-Thomson effect and associated temperature drop at the recirculation valve 72 in one embodiment.

The inlet valve 56 can be shut during a condition where high oxygen concentration is present at the inlet of the recovery system. If the oxygen at the inlet of the system is detected to rise above a target set point (i.e. greater than three percent (3%) in one embodiment) the inlet valve 56 closes. In one embodiment, if inlet oxygen concentration is detected to be above this set point, the PLC 60 could signal the inlet valve 56 to close for 1 minute, then subsequently open for ten seconds, repeating until the inlet oxygen settles below the set point (3% in one embodiment). Once a continuous feed of vapor 44 containing an oxygen concentration that is below the desired set point is being received, the inlet valve 56 will no longer be commanded to shut in due to detection of high oxygen concentration at the inlet. By closing the inlet valve 56 at a set point corresponding to the oxygen concentration at the inlet of the recovery system 20, where this set point (i.e. 3%, or 30,000 parts per million) is below a concentration that could potentially lead to overheating the reactor vessel 67 or its contents (i.e. 3.5% or 35,000 parts per million) due to the exothermic nature of the catalytic reaction that destroys/removes oxygen from the flash gas, introduction of excess oxygen that could potentially cause this adverse situation where compromised integrity of the reactor vessel structure, and/or damage to the catalyst inside the vessel is prevented. The closure of the inlet valve 56 and placement of system 20 into recirculation mode, where oxygen is continuously removed during operation with the inlet valve 56 closed, can reduce or eliminate the possible catalytic reaction induced temperature rise across the reactor 67 before more oxygen is introduced.

The inlet valve 56 can be opened under a condition where pressure that is lower than desired is detected downstream of the final stage of compression 62. In one example, this pressure can be detected at one or more locations in the recovery system that is downstream of the discharge of the final stage of compression, i.e. at sensor 74 or at the piping downstream of the final stage of compression's discharge flange, the heat exchanger, the reactor vessels, the reactor discharge cooler, or the piping between the reactor discharge cooler and the recovery system's discharge flange that mates to the gas gathering pipeline. If the pressure downstream of the final stage of compression 62 is detected to be below a low side discharge pressure set point (i.e. 300 psig in one embodiment), and the inlet valve 56 is closed due to certain other conditions described herein (i.e. high oxygen concentration at the outlet of the recovery system), the PLC 60 can direct inlet valve 56 to open until the pressure downstream of the final stage of compression 60 reaches a high-side low discharge pressure set point (i.e. 310 psig in one embodiment), as long certain conditions are not present as described herein (i.e. oxygen concentration at the inlet is not too high and/or a vacuum condition is not present at the oil storage tanks 26).

The inlet valve 56 can be closed under condition of a shutdown requiring the system 20 to stop operation. In one embodiment, potential causes of a shutdown that would require the recovery system 20 to halt operation (i.e. stopping the engine and compressor 62 from turning) include a continuous low pressure or vacuum condition upstream of the inlet valve 56 despite the inlet valve 56 being shut, low or no engine lubrication oil pressure, low or no compressor lubrication oil pressure, low engine lubrication oil fill level in the engine crank case, low compressor lubrication fill level in the compressor crank case, high engine coolant temperature, low engine coolant fill level, high liquid level inside the suction scrubber(s) of any stage of compression, high temperature at or within the reactor vessel(s) 67, high or low pressure inside the suction scrubber(s) of any stage of compression 62, high levels of vibration detected at the engine, compressor, or cooler, high temperature at the inlet or discharge of any stage of compression, failure of the engine to start, engine over speed, or the presence of high levels of explosive gas in the ambient environment. If the system experiences or detects a condition requiring shut down, the PLC 60 will command the inlet valve 56 will close. In one embodiment, if the inlet valve 56 is configured to be normally closed (NC), this can be achieved by removing the signal that opens the inlet valve 56. The valve 56 will not open again until the cause of the shutdown has been eliminated and the system 20 has been reset.

The inlet valve 56 can be used to throttle the system 20 volumetric flow rate as this is influenced directly by its position. If the inlet valve 56 is in the fully closed position, the volumetric output of the system 20 drops to zero because no new gas 44 is allowed to enter the recovery system 20 across the system boundary. Alternatively, if the inlet valve 56 is in the fully open position (assuming the system 20 is in operation and the recirculation valve 72 is fully closed), the recovery system 20 can recover and discharge gas at its full capacity, which is largely determined by the specific equipment (i.e. compressor 62) in use. In one embodiment, alternating the position of the inlet valve 56 between open and closed would achieve a reduced output over time. Alternatively, in one example, positioning the inlet valve 56 at a point between the limits of fully opened and fully closed, would have the effect of "throttling" the volumetric output as measured on an instantaneous basis. (i.e., due to too rich of an oxygen concentration on a blended basis in one embodiment). In one embodiment, this method of reducing the volumetric output of a recovery system could be beneficial if the resulting blend of recovered gas (high oxygen concentration) and traditionally produced gas (low oxygen concentration) would contain an oxygen concentration that is higher than a certain specification, which can be determined by the operators of an associated gas gathering pipeline. By reducing the throughput of the recovery system 20, and therefore the flow rate of oxygen rich gas, the resulting blend of recovered gas 30 and traditionally produced gas could be brought within the gas gathering pipeline's specification while not entirely closing the inlet valve 56 and therefore not entirely eliminating any flow through the recovery system 20.

In one example, it is beneficial to configure the inlet valve 56 to fail to a closed position. If the system 20 loses power (i.e., the batteries fail, in one example) then the inlet valve 56 is de-energized and will close as a fail-safe measure.

Referring again to FIG. 1, at the well head 34, fluids are produced that include water, oil and gas/vapors, which enter straight into a three-phase separator 36 where those three constituents are separated. The gas/vapor goes into its own pressurized gas gathering pipeline (shown as 38), and the operating pressure of said gas gathering pipeline determines the operating pressure of the three phase separator 36. Water is sent to its own specific produced water storage tank(s) 40 and oil (i.e., liquid-phase hydrocarbons) are sent into one or more oil condensate storage tanks 26 that are kept at nearly atmospheric pressure (i.e. 0-1 psig). The tank pressure sensor 53 senses the pressure inside the oil storage tanks 26. This sensed pressure is one of the inputs used by the controller to determine whether or not the inlet valve 56 should be opened (other parameters include that the proper levels of oxygen concentration are detected on the inlet and low oxygen concentration levels are detected at the outlet).

If the tank pressure has risen to a point (i.e., 1.5 oz/square inch) that the controller 60 has determined that enough pressure (and therefore flash gas 44) exists within the tanks to warrant the recovery process, the controller 60 can direct that the inlet valve 56 can be opened in one example.

Once vapor passes through the inlet valve 56, it then passes through a check valve 54 that only allows one-directional flow from the tanks 26 into the inlet scrubber 55 and subsequently, compression by the recovery system 20. The compressor suction pressure is measured with a compressor suction pressure sensor 57 that can be located on the inlet scrubber vessel 55. At that point, the vapor/gas moves through the flame arrestor 58 located upstream of the compression system 62 and into the compression system 62 where its pressure is increased and pumped through the compressor. The vapor/gas is then in one example heated by means of a heating system 64, and passed through another flame arrestor 66 located, in one example, upstream of the reactor vessels 67 where the gas/vapor enters into the oxygen removal reactor(s) 67 (with, for example, a sulfur scavenging bed) before it enters the oxygen removing catalyst within the reactor 67. After that, the gas is cooled down by the cooler 68 (which could take the form of an air-cooled heat exchanger, or an engine coolant-cooled heat exchanger in various embodiments), because the gas/vapor exiting the reactor vessel(s) is generally hot. At that point, a reading of the oxygen content in the gas/vapor stream is measured at the outlet by the outlet oxygen sensor 70. Assuming that all levels and parameters are within specification as described herein, the recirculation valve 72 remains closed causing the gas to continue to flow downstream through an optional back pressure regulator 76 which maintains pressure at a set point upstream and that can be anywhere between 200 psig to 500 psig. The gas/vapor continues through the flow meter 46 where the volumes are calculated and stored; and the gas/vapor passes through another check valve 47 that only allows one way flow where the gas is then passed into a gas pipeline 24 where it is blended with the traditional production gas (such as has that first came out of the three phase separator) before it goes to another flow meter in series with the gas pipeline in one embodiment.

Depending on the pressure of the flash gas held within the oil condensate storage tanks 26, assuming that oxygen concentrations at the inlet and the outlet 52 and 70 of the compressor 62 or reactor system 67 are within appropriate levels and that there is not a high discharge pressure condition at sensor 74, if the tank pressure at sensor 53 in the oil condensate tanks 26 goes below a set point (which could be 0.25 of an ounce per square inch), at that point the inlet valve 56 will be closed by the controller 60 to avoid a vacuum condition in the oil storage tanks 26 where air would actually be sucked into them through the vacuum seal on the thief hatch 27. Assuming the compressor 62 is in operation and continues to run, this will prevent any additional volume of new flash gas 44 from entering through that inlet valve 56 into the compression inlet scrubber 55. A condition of lower pressure than that which would exist if the inlet valve 56 was open (i.e. a slight vacuum in one example where the inlet of the recovery system might be connected to oil storage tanks) is generated between the piping of the inlet valve 56, inside the inlet scrubber 55 and up to the compressor suction flange because the compressor 62 is continuing to evacuate gas in that piping and within in the compressor inlet suction scrubber vessel 55. However, no more gas is being introduced because the inlet valve 56 is closed and does not allow any gas to move through it when it is in the position. This causes the closed feedback control loop within the PLC 60 to initiate the recirculation mode, wherein the closed feedback loop control system maintains the pressure within the piping downstream of the inlet motor valve and in the initial stage of compression's inlet suction scrubber through the piping that connects to compressor suction flange to a pressure that is specified as the set point of the PID closed feedback control loop. The process variable of the PID closed loop feedback control is pressure as read by the compressor suction pressure sensor 57. In one embodiment, this pressure can be read as absolute pressure so that this pressure can be sensed in a vacuum or positive pressure range, and so that the pressure can be controlled by the PID controller 60.

Referring to FIG. 3, the output of the controller 60 proportionately controls the lift of the recirculation valve 72. In one example, where the inlet of the recovery system 20 is connected to oil storage tanks with a maximum allowable working pressure that is near atmospheric pressure, the PID set point of compressor suction pressure 57 can be configured to be just below atmospheric pressure. The elements of the process control described herein therefore include the control output signal as shown in FIG. 3 which controls the lift of the recirculation valve 72, the control process variable (i.e., compressor suction pressure), and the control set point (i.e., compressor suction pressure set point, as shown in FIG. 3). When the compressor suction pressure 57 drops below the control set point (i.e. compressor suction pressure set point) in the compressor inlet suction scrubber vessel 55, the compressor suction pressure sensor 57 detects this change in the process variable as the PLC's PID closed feedback control loop logic 60 sees a growing error between the control set point and the process variable. Accordingly, through a proportional integral and derivative controller (also known as a PID closed loop controller), the controller 60 will direct the recirculation valve 72 to open appropriately so that the recirculation valve 72 can let an appropriate amount of gas flow through the recirculation valve 72 to provide sufficient gas volume to the compressor inlet suction scrubber 55 and thereby the inlet of the compression system 62, therefore alleviating and/or preventing a deep vacuum condition upstream of the compressor 62.

As described herein, a make-up gas valve 80 may be coupled to system 20, to provide additional gas volume, when needed, for injection immediately upstream of the compressor inlet/suction. The gas volume provided by the make-up gas valve 80 can be provided from multiple sources, including but not limited to the sales pipeline 24 or a dedicated fuel/supply gas line for startup or other scenarios when adequate volumes of gas from the oil storage tanks 26 is not available and higher discharge pressures are required. The reason that higher discharge pressures could be desired, requiring the operation of the make-up gas valve 80 and the gas volume it supplies, is when the pressure contained within the recovery system 20 is less than desired. In one embodiment, this low pressure condition could be measured by controller 60 at various points of the recovery system 20, including at the suction sensor 57 of the initial stage of the compressor (i.e. at the first stage inlet suction scrubber 55 in one example), or downstream of the final stage of compression 62 (i.e. at the final stage of compression's discharge flange, heat exchanger or the reactor vessel(s) 67 in one example). One reason for this scenario of a low pressure "charge" include but are not limited to system startup following full depressurization of the system. Also, if the system 20 has been in recirculation mode for an extended period of time, where no new material/flash gas 44 is introduced through the closed inlet valve 56, some amount of gas can condense into the liquid form within the scrubbers 55. Not only do liquids occupy substantially less volume than the same material in the gas state, but these liquids that collect are then dumped from the scrubber vessel(s) 55 and may be returned to the oil storage tanks 26, thereby crossing and exiting the system boundary, leaving less material/processed gases, and thus less pressure, within the system 20. Maintaining a sufficient pressure within the system 20, especially at the discharge of the final stage of compression, within the reactor vessels, and immediately upstream of the recirculation valve 72, can be desirable for a multitude of reasons. These reasons include but are not limited to the following: the oxygen removal reaction 67 operates more efficiently at high pressures and high temperatures (i.e. above 300 psig and 400 degrees Fahrenheit in one embodiment). By opening the make-up gas valve 80 to supply additional volume/material/gas into the system boundary when the primary source of new volume (i.e. flash gas 44 from the oil storage tanks 26) is not available, pressure within the system 20 rises proportionately to the amount of new volume that is introduced. Furthermore, a higher temperature rise that gas experiences during compression (commonly referred to as "heat of compression" and therefore a higher temperature within the oxygen removal reactors 67) results from a proportionately higher pressure rise during compression. Said differently, the more a gas is compressed, the more the temperature of the gas will increase as a consequence, resulting in higher efficiencies of the oxygen removal reaction.

Figure 2:
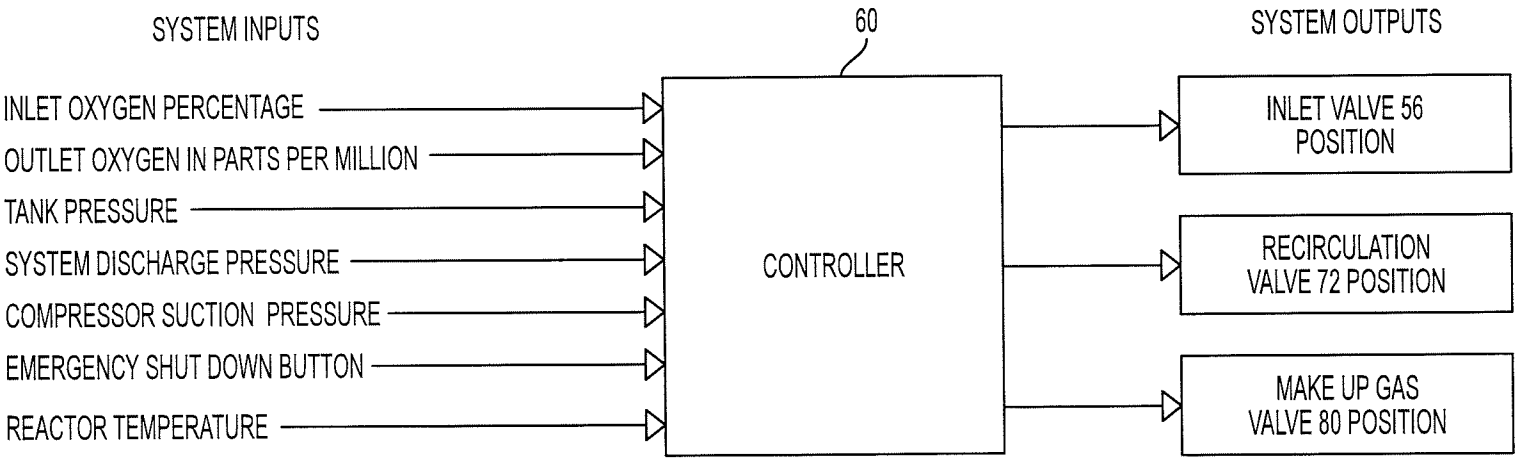
FIG. 2 illustrates a block diagram of an example of a controller of a vapor recovery system, the controller having a plurality of inputs and a plurality of outputs, in accordance with one embodiment of the present disclosure.

FIG. 2 illustrates a block diagram of an example of a controller of a vapor recovery system, the controller having a plurality of inputs and a plurality of outputs, in accordance with one embodiment of the present disclosure. As shown in FIGS. 1-2, controller 60 may have a plurality of inputs such as but not limited to an inlet oxygen sensor (percentage/content) (such as 52), an outlet oxygen sensor (content) (such as 70), a tank pressure sensor (such as 53), a system discharge pressure sensor (such as 74), a compression suction pressure sensor (such as 57), one or more reactor temperature sensors (such as 69), and an emergency shutdown button. The controller 60 may have one or more outputs, such as an output that controls the inlet valve 56, the recirculation valve 72, and make-up gas valve 80.

In one example, if the inlet oxygen concentration is too high, controller 60 will shut the inlet valve 56. One example of the controller logic 60 may include if the oxygen concentration at the inlet of the recovery system 20, as sensed by the inlet oxygen sensor 52, is detected to be above 3% by volume, the controller 60 sends a signal to close the inlet valve 56 for 60 seconds, then reopen it for a minimum of 10 seconds, unless oxygen concentration is determined to be in the range of an explosive mixture for the specific flash gas composition, in which case the system could be shut down. Though this operation of cycling the position of the inlet valve 56 between open and closed, the recovery system 20 is to continue to detect the concentration of oxygen contained within the gas located upstream of the inlet valve while avoiding a high temperature condition at the reactor vessel(s) 67. Once the oxygen concentration falls below a level that is determined to be too high (i.e. 3% in one example) the inlet valve 56 will no longer be signaled to close based on this input. If the outlet oxygen concentration is too high, the controller 60 will shut the inlet valve 56. One example of the controller logic may include that if the oxygen concentration at the outlet, as sensed by the outlet oxygen sensor 70, is detected to be above a set point (i.e. a concentration that corresponds to a concentration that is above the gas pipeline's required specification of 10 parts per million when blended with traditionally produced gas coming from the three-phase separator as determined at the flow meter entering the gas pipeline), the controller 60 sends a signal to close the inlet valve 56 until the oxygen concentration at the outlet of the recovery system's reactor vessel(s) 67 is determined to be less than the set point described above, at which point the signal to close the inlet valve 56 based on outlet oxygen concentration will be removed. If the upstream pressure at the oil storage tank(s) is high enough and no other parameters dictate otherwise, the controller will open that inlet valve 56 if the pressure goes above a high set point (for example, remaining above 1.5 ounces per square inch continuously for 5 seconds). However, if the tank pressure 53 goes below the bottom window of that set point (for example, remaining below 0.25 ounces per square inch continuously for 5 seconds), the controller 60 will shut the inlet valve 56 fully in one example. If the discharge pressure of the recovery system, as sensed by the final stage of compression discharge pressure sensor 74 or the reactor pressure sensor rises above a high window of a high pressure set point (i.e. 390 psig in one example), the controller 60 signals the inlet valve to shut fully, until discharge pressure drops below a low window of a high pressure set point (i.e. 370 psig in one example), at which point the controller 60 will remove the signal to fully shut the inlet valve 56. If discharge pressure of the recovery system falls below a low window of a low pressure set point (i.e. 300 psig in one example) the controller 60 signals the inlet valve 56 to open, until discharge pressure of the recovery system 20 rises above a high window of a low pressure set point (i.e. 310 psig in one example) at which point the signal to fully open the inlet valve 56 will be removed. If the temperature of the oxygen-removal reactor vessel(s), as sensed at any of a plurality of reactor temperature sensors, reaches a high window of a high temperature set point, the controller 60 will signal the inlet valve 56 to fully shut, until the reactor temperature 69 drops below the low window of a high temperature set point, at which point the signal to fully shut the inlet valve 56 will be removed. If any shutdown condition(s) is present, the controller 60 will remove all signals to open the inlet valve 56 and instead signal it to fully shut. In one example, the inlet valve 56 control is either fully open or fully closed.

Referring back to FIG. 3 and the proportional integral and derivative closed-loop feedback control system, which can be implemented using controller 60, three components of the system include the set point (e.g., the parameter that is being controlled), the process variable (e.g., the current state at which that parameter exists), and the control signal that actually would change or influence the process variable. In this case, the set point is the pressure that exists at the suction at the compressor suction, where it is desirable in one example to have this be no lower than just below atmospheric pressure (i.e. 0.1 psig vacuum). The process variable is the actual pressure at the suction of the compression system at a given moment as measured by sensor 57, which could range from a full vacuum (zero psi absolute) to 30 psig (44.7 psi absolute at sea level) in one embodiment.

The proportional part of the controller measures purely the deviation or difference between the set point and the measured process variable. The further the measured variable is from the set point, the more that the proportional component tries to push the measured variable back to the set point.

The integral part of the controller looks back over a given amount time and it determines how far off has the process variable been from the set point over this time period. In one embodiment, a 30-second "reset" or time window can be used to determine how far off the process variable is from the set point, and the integral portion bumps the output in a way that moves the process variable closer to the set point.

The derivative component of the controller detects the rate of change which helps predict where the process variable is heading. In one example, the derivative term is assigned a value of zero so only the proportional and integral components are used.

In one example of operation of FIG. 3, assume that the inlet valve 56 is closed and a pressure below the control set point (i.e. a vacuum in one embodiment) develops in the first stage vessel, upstream of the compressor section. The pressure sensor senses the process variable to be a pressure lower than the control set point, and the proportional component determines that there is a significant error term or variance between the set point and the measured state/process variable. The proportional component then tries to adjust the process variable by increasing the control signal, which, in one embodiment, is directly and proportionally controlling the lift of the recirculation valve 72 allowing a directly and proportionally higher flow rate to move through the recirculation valve, which thereby moves the pressure at the compressor suction (i.e. process variable) closer towards the set point. The proportional term component will get the control process variable (i.e. compressor suction pressure) very close so the control set point (i.e. a pressure slightly below atmospheric pressure in one embodiment) but it will always be within some infinitesimal difference. The integral component or the "reset" term value can be used to bump the process variable to the set point.

FIGS. 4A-4B illustrate an example of a process for a vapor recovery system, in accordance with one embodiment of the present disclosure. One or more operations of FIG. 4A-4B can be implemented by the controller 60 or by other components in a vapor recovery system 20, depending upon the implementation. It is understood that the operations of FIGS. 4A-4B are provided by way of example only, and that other embodiments could be formulated or configured using differing operations or different order of operations.

At operation 210, a vapor recovery system is connected to one or more flash gas sources such as oil storage tanks or other sources. At operation 212, various conditions and sensors can be checked. In one example, if the inlet oxygen level is less than 3%, and the outlet oxygen content is less than 8 ppm, and the compressor discharge pressure is less than the High-Pressure Shut Down Set point, and no system shutdowns are present, then control is passed to operation 216. Otherwise, control is passed to operation 214 where in one example the engine is stopped, the inlet valve 56 is closed, the recirculation valve 72 is opened, and the system is depressurized.

At operation 216, oil is produced to the storage tank(s) from pressurized source (i.e. oil-gas separator in one embodiment), and at operation 218, some of the oil in liquid form flashes/evaporates into the gas/vapor state due to the apparent drop in pressure. At operation 220, as gas occupies more volume than liquid, the additional flashed gas increases the pressure in the storage tanks to a pressure elevated above atmospheric pressure.

At operation 222, the tank pressure sensor senses the increased pressure, and at operation 224, once the tank pressure sensor senses that pressure in the oil storage tanks has risen above a high set point for oil tank pressure (i.e., 1.5 oz./in$^2$ in one embodiment), the tank pressure sensor signals the inlet valve 56 to open (via open loop control in one example), for instance through a controller.

At operation 226, the inlet valve 56 opens, and at operation 228, the compressor inlet scrubber & compressor suction flange are now in fluid communication with the oil storage tanks across the open inlet valve 56. At operation 230, the compressor inlet scrubber & compressor suction flange are now at the same elevated pressure as the oil storage tanks.

At operation 232, the compressor suction scrubber pressure sensor senses this elevated pressure (above atmospheric pressure), and at operation 234, the compressor suction scrubber pressure sensor signals that the recirculation valve 72 remain closed (via closed loop control in one example), because the set point for the recirculation valve 72 is slightly below atmospheric pressure (i.e. −0.1 psig in one embodiment).

At operation 236, the recirculation valve 72 remains closed, and at operation 238, with the inlet valve 56 OPEN and the recirculation valve 72 CLOSED, the compressor continues to run in a pass-through mode, sucking out vapor/gas volume from the one or more oil tanks. At operation 240, pressure inside the oil storage tanks is reduced as gas volume is removed.

At operation 242, once the tank pressure sensor senses that pressure in the oil storage tanks has fallen below a low set point for oil tank pressure (i.e. 0.25 oz./in$^2$ in one embodiment), the tank pressure sensor signals that the inlet valve 56 should close (via for example, open loop control). A controller may be used to control the inlet valve 56.

At operation 244, the inlet valve 56 closes. At operation 246, as the compressor continues to run, it pulls in gas at its suction but no additional volume is introduced through the inlet valve 56.

At operation 248, a vacuum (i.e. pressure <0 psig) is generated at the compressor suction flange and inside the compressor inlet scrubber vessel. At operation 250, the compressor suction scrubber pressure sensor senses this vacuum pressure (below set point) and signals the recirculation valve 72 to open (via closed loop control in one example). A controller may be used to control the recirculation valve 72.

At operation 252, gas flows from the compressor discharge (high pressure) through the recirculation valve 72, back to the Compressor Suction, alleviating vacuum pressure at the inlet scrubber. At operation 254, gas flow reaches equilibrium as the recirculation valve 72 opens the appropriate amount (as controlled by closed control loop in one example) to maintain the set point pressure at the compressor suction/inlet scrubber vessel (i.e. −0.1 psig in one embodiment). Volumetric flow is approximately equal through both the compressor and the recirculation valve 72. At operation 256, full recirculation is achieved, as no gas exits the system's boundary at inlet and/or discharge at this time.

As described herein, the system 20 discharges recovered gas/vapor 30 into the gas pipeline 24 under appropriate conditions.

FIG. 5 shows one example of a pass-through mode for system 20, wherein inlet valve 56 is open and recirculation valve 72 is closed. Flash gas 44 enters the system 20, is processed by the system into recovered gas 30, and passed into sales line 24.

FIG. 6 shows one example of a recirculation mode for system 20, wherein inlet valve 56 is closed and recirculation valve 72 is open. No flash gas 44 enters the system 20, and the gas within system 20 is recirculated and is not passed into sales line 24, until a time when pass-through mode is resumed. During recirculation mode, flash gas present within source 26 may be incinerated by burner 28.

FIG. 7 illustrates a Table showing an example of input conditions for the recirculation mode and pass-through mode for operation of system 20, in accordance with one embodiment of the present disclosure. It is understood that FIG. 7 is provided by way of example only, and that a recovery system 20 could be formulated using differing inputs and differing input conditions.

FIG. 8 illustrates an example of a vapor recovery system 20 positioned on a platform or skid 84, in accordance with one embodiment of the present disclosure. As described herein, the recirculation of gases within system 20 can occur within the boundaries of the platform 84, which has various advantages as described herein.

Accordingly, it can be seen that embodiments of the present disclosure show and describe various systems and methods for recovering vapors/gases in a system utilizing selective recirculation.

While the methods disclosed herein have been described and shown with reference to particular operations performed in a particular order, it will be understood that these operations may be combined, sub-divided, or re-ordered to form equivalent methods without departing from the teachings of the present disclosure. Accordingly, unless specifically indicated herein, the order and grouping of the operations is not a limitation of the present disclosure.

It is understood that the directional references provided herein, such as top, bottom, upwards, downwards, clockwise, counterclockwise, left, right, and the like, are provided to describe examples of the embodiments disclosed herein, and are not intended to be limiting.

It should be appreciated that in the foregoing description of exemplary embodiments of the disclosure, various features of the disclosure are sometimes grouped together in a single embodiment, Figure, or description thereof for the purpose of streamlining the disclosure and aiding in the understanding of one or more of the various aspects. This method of disclosure, however, is not to be interpreted as reflecting an intention that the claims require more features than are expressly recited in each claim. Rather, inventive aspects lie in less than all features of a single foregoing disclosed embodiment, and each embodiment described herein may contain more than one inventive feature.

While the disclosure is presented and described with reference to embodiments thereof, it will be understood by those skilled in the art that various other changes in the form and details may be made without departing from the spirit and scope of the disclosure.

What is claimed is:

1. A system for recovering flash gas from at least one flash gas source, comprising:

a controllable inlet valve having an input coupled with the flash gas source, the inlet valve receiving the flash gas, the inlet valve having an output;

a compressor having an input coupled with the output of the inlet valve, the compressor configured to receive the flash gas from the inlet valve when the inlet valve is open, the compressor compressing the flash gas to form compressed gas, the compressor providing the compressed gas at an output;

a controllable recirculation valve coupled between the output of the compressor and the output of the inlet valve; and a controller coupled with the inlet valve and the recirculation valve, the controller selectively controlling the inlet valve and the recirculation valve between i) a pass-through mode wherein the inlet valve is open and the recirculation valve is closed, and ii) a recirculation mode wherein the inlet valve is closed and the recirculation valve is opened.

2. The system of claim 1, further comprising a pressure sensor measuring a pressure of flash gas in the flash gas source, and wherein the controller activates the pass-through mode when the pressure sensor detects pressure within the flash gas source that is above a desired set point.

3. The system of claim 1, further comprising a pressure sensor measuring a pressure of flash gas in the flash gas source, and wherein the controller activates the recirculation mode when the pressure sensor detects pressure within the flash gas source that is below a desired set point.

4. The system of claim 1, further comprising a pressure sensor measuring a pressure of suction at the input of the compressor, and wherein the controller activates the pass-through mode when the pressure of suction is above a desired set point.

5. The system of claim 1, further comprising a pressure sensor measuring a pressure of suction at the input of the compressor, and wherein the controller activates the recirculation mode when the pressure of suction is at or below a desired set point.

6. The system of claim 1, further comprising an outlet pressure sensor measuring an outlet pressure at the output of the compressor, and wherein the controller activates the pass-through mode when the outlet pressure is below a desired set point.

7. The system of claim 1, further comprising an outlet pressure sensor measuring an outlet pressure of at the output of the compressor, and wherein the controller activates the recirculation mode when the outlet pressure is above a desired set point.

8. The system of claim 1, further comprising an inlet oxygen sensor measuring an oxygen content level of the flash gas at the input of the compressor, and wherein the controller activates the pass-through mode when the oxygen content level is below a desired set point.

9. The system of claim 1, further comprising an inlet oxygen sensor measuring an oxygen content level of the flash gas at the input of the compressor, and wherein the controller activates the recirculation mode when the oxygen content level is above a desired set point.

10. The system of claim 1, further comprising an outlet oxygen sensor measuring an oxygen content level of the compressed gas at the output of the compressor, and wherein the controller activates the pass-through mode when the oxygen content level of the compressed gas is below a desired set point.

11. The system of claim 1, further comprising an outlet oxygen sensor measuring an oxygen content level of the compressed gas at the output of the compressor, and wherein the controller activates the recirculation mode when the oxygen content level of the compressed gas is above a desired set point.

12. The system of claim 1, wherein the inlet valve, the compressor, the recirculation valve and the controller are positioned on a platform, and when the system is operating in recirculation mode, no flash gas enters the system from the flash gas source and no compressed gas exits the system.

13. The system of claim 1, further comprising an oxygen reduction subsystem receiving the compressed gas from the compressor, the oxygen reduction subsystem reducing an amount of dioxygen contained within the compressed gas.

14. A system for recovering flash gas from at least one flash gas source, comprising:

a controllable inlet valve having an input in fluid communications with the flash gas source to receive the flash gas, the inlet valve having an output;

a compressor having an input in fluid communications with the output of the inlet valve to receive the flash gas when the inlet valve is open, the compressor compressing the flash gas to form compressed gas, the compressor providing compressed gas at an output;

a controllable recirculation valve in fluid communications with the output of the compressor and the output of the inlet valve; and a controller coupled with the inlet valve and the recirculation valve, the controller selectively controlling the inlet valve and the recirculation valve between i) a pass-through mode wherein the inlet valve is open and the recirculation valve is closed, and ii) a recirculation mode wherein the inlet valve is closed and the recirculation valve is opened and no flash gas enters the system from the flash gas source and no compressed gas exits the system in the recirculation mode.

15. The system of claim 14, further comprising a pressure sensor measuring a pressure of flash gas in the flash gas source, and wherein the controller activates the pass-through mode when the pressure sensor detects pressure within the flash gas source that is above a desired set point.

16. The system of claim 14, further comprising a pressure sensor measuring a pressure of flash gas in the flash gas source, and wherein the controller activates the recirculation mode when the pressure sensor detects pressure within the flash gas source that is below a desired set point.

17. The system of claim 14, further comprising a pressure sensor measuring a pressure of suction at the input of the compressor, and wherein the controller activates the pass-through mode when the pressure of suction is above a desired set point.

18. The system of claim 14, further comprising a pressure sensor measuring a pressure of suction at the input of the compressor, and wherein the controller activates the recirculation mode when the pressure of suction is at or below a desired set point.

19. The system of claim 14, wherein the inlet valve, the compressor, the recirculation valve and the controller are positioned on a platform.

20. The system of claim 14, further comprising an oxygen reduction subsystem in fluid communications with the compressor to receive the compressed gas, the oxygen reduction subsystem reducing an amount of dioxygen contained within the compressed gas.

* * * * *